US005849453A

United States Patent [19]

Mikuriya et al.

[11] Patent Number: 5,849,453

[45] Date of Patent: Dec. 15, 1998

[54] IMAGE FORMING METHOD INCLUDING RECYCLING OF UNTRANSFERRED TONER COLLECTED FROM IMAGE BEARING MEMBER TO DEVELOPING MEANS

[75] Inventors: Yushi Mikuriya, Kawasaki; Masaki Uchiyama; Yasutaka Akashi, both of Yokohama, all of Japan

[73] Assignee: Canon Kabushiki Kaisha, Tokyo, Japan

[21] Appl. No.: 72,950

[22] Filed: Jun. 8, 1993

[30] Foreign Application Priority Data

Jun. 8, 1992 [JP] Japan ..... 4-171522

[51] Int. Cl.[6] ..... G03G 21/00

[52] U.S. Cl. ..... 430/125; 430/122; 430/126; 430/111; 399/359

[58] Field of Search ..... 430/122, 111, 430/102, 125, 126; 399/359

[56] References Cited

U.S. PATENT DOCUMENTS

| | | | |
|---|---|---|---|
| 2,297,691 | 10/1942 | Carlson | 95/5 |
| 3,942,979 | 3/1976 | Jones et al. | 96/1 |
| 3,969,251 | 7/1976 | Jones et al. | 252/62.1 P |
| 4,122,024 | 10/1978 | Jones et al. | 252/62.1 P |
| 4,299,900 | 11/1981 | Mitsuhashi et al. | 430/122 |
| 4,666,815 | 5/1987 | Imai et al. | 430/126 |
| 5,009,973 | 4/1991 | Yoshida et al. | 430/122 |
| 5,017,967 | 5/1991 | Koga | 355/261 |
| 5,175,070 | 12/1992 | Tanikawa et al. | 430/122 |
| 5,202,731 | 4/1993 | Tanikawa et al. | 355/251 |

FOREIGN PATENT DOCUMENTS

| | | |
|---|---|---|
| 0432752A3 | 6/1991 | European Pat. Off. . |
| 0445986A1 | 9/1991 | European Pat. Off. . |
| 0449323A1 | 10/1991 | European Pat. Off. . |

OTHER PUBLICATIONS

European Search Report for EP 93 10 9100.

(List continued on next page.)

*Primary Examiner*—Christopher D. Rodee
*Assistant Examiner*—Laura Weiner
*Attorney, Agent, or Firm*—Fitzpatrick, Cella, Harper & Scinto

[57] ABSTRACT

An image forming method has the steps of forming a toner image by developing through a developing means a latent image formed on a latent image bearing member; transferring the toner image formed, from the latent image bearing member to a transfer medium through a transfer means to which a bias is applied; cleaning the latent image bearing member from which the toner image has been transferred to the transfer medium, to recover and collect the toner remaining on the latent image bearing member; and feeding the toner recovered and collected, to the developing means for reuse in the developing step. The toner has a binder resin and at least one of a magnetic powder and a colorant. The toner has a weight average particle diameter ($D_4$) of from 4 $\mu$m to 11 $\mu$m; a coefficient A of variation of number-base distribution, of not more than 40, which is a coefficient represented by the formula:

$$A=S_n/D_1\times 100$$

wherein $S_n$ represents a standard deviation of number-base distribution, and $D_1$ represents a length average particle diameter ($\mu$m) on the basis of number; and a coefficient B of variation of volume-base distribution, of not more than 30, which is a coefficient represented by the formula:

$$B=S_W/D_4\times 100$$

wherein $S_W$ represents a standard deviation of volume-base distribution, and $D_4$ represents a weight average particle diameter ($\mu$m) on the basis of weight.

11 Claims, 6 Drawing Sheets

FOREIGN PATENT DOCUMENTS

| | | |
|---|---|---|
| 17-23910 | 11/1942 | Japan . |
| 18-24748 | 10/1943 | Japan . |
| 51-3244 | 1/1976 | Japan . |
| 54-072054 | 6/1979 | Japan . |
| 58-129437 | 8/1983 | Japan . |
| 0104566 | 4/1989 | Japan . |
| 1214874 | 8/1989 | Japan . |
| 2-110572 | 4/1990 | Japan . |
| 0311389 | 6/1990 | Japan . |
| 2157765 | 6/1990 | Japan . |
| 02284156 | 11/1990 | Japan . |

HISTOGRAM OF NUMBER-BASE DISTRIBUTION
OF SUPPLY TONER OF EXAMPLE 1

HISTOGRAM OF VOLUME-BASE DISTRIBUTION
OF SUPPLY TONER OF EXAMPLE 1

HISTOGRAM OF NUMBER-BASE DISTRIBUTION
OF COLLECTED TONER OF EXAMPLE 1

HISTOGRAM OF VOLUME-BASE DISTRIBUTION
OF COLLECTED TONER OF EXAMPLE 1

IMAGE FORMING METHOD INCLUDING RECYCLING OF UNTRANSFERRED TONER COLLECTED FROM IMAGE BEARING MEMBER TO DEVELOPING MEANS

BACKGROUND OF THE INVENTION

1. Field of the invention

The present invention relates to an image forming method in electrophotography or electrostatic printing. More particularly, it relates to an image forming method having a system in which untransferred toner remaining on a latent image bearing member is collected through a cleaning step and is returned for reuse.

2. Related Background Art

A number of methods as disclosed in U.S. Pat. No. 2,297,691, Japanese Patent Publications No. 42-23910 and No. 43-24748 and so forth are known for electrophotography. In general, copies are obtained by forming an electrostatic latent image on a photosensitive member by utilizing a photoconductive material and, by various means, subsequently developing the latent image by the use of a toner, transferring the developed toner image to a transfer medium such as paper, and the fixing transferred toner image by the action of heat, pressure, heat-and-pressure or solvent vapor. In the above steps, untransferred toner remains on the latent image bearing member in a quantity of, e.g., 10 to 20% by weight after the toner image has been transferred to a transfer medium, and the untransferred toner conventionally has been recovered or collected through a cleaning step and discharged out of the system as a waste toner.

In recent years, however, with an increase in demand for copying machines, there is an increasing demand for machines with a large copy volume, i.e., large-sized high-speed copying machines. In such high-speed copying machines, the waste toner comes out in a large quantity and hence, when disposed as a waste (waste plastic), has a possibility of causing environmental pollution. Accordingly, recent studies have been conducted on how to reuse this waste toner. If it becomes possible to reuse the waste toner, then the following advantages would result: toners can be used effectively, machine space can be simplified and machines can be made compact.

However, when the waste toner has been reused, there have been adverse effects such that the reflection image density decreases, ground fog and reversal fog increase and toner scatter occurs.

Such effects hitherto were believed to be due to paper dust or the like contained in the waste toner and, as a countermeasure thereto, it has been attempted to provide a meshed member on the path through which the waste toner is collected. Such a system, however, is complicated in itself and has caused difficulties such that paper dust or the like accumulates on the meshed member to cause a collection path to clog with the waste toner.

Taking note of transport properties and durability of the waste toner, a method taking account of toner constitution is disclosed in Japanese Patent Application Laid-open No. 1-214874, No. 2-110572, etc. There, however, is a possibility of causing difficulties such that anti-blocking properties becomes poor.

Japanese Patent Application Laid-open No. 2-157765 discloses a recycle system in which particle size distribution of toner is defined. The invention disclosed therein, however, is limited to a dry two-component development system and also its toner comprises particles having relatively large diameters of from 3 to 20 μm in volume average particle diameter. Toners with such particle diameters tend to cause a decrease in reflection image density as images are repeatedly reproduced.

U.S. Pat. No. 4,299,990 discloses a toner projection development system making use of a developer comprising a magnetic toner with diameters of 20 to 35 μm contained in an amount of 10 to 50% by weight. Toner particle size is so designed as to be suited to triboelectrically charge the magnetic toner, to form a toner layer uniformly thinly on a sleeve and also to improve environmental properties of the magnetic toner. Japanese Patent Application Laid-open No. 2-284156 discloses a toner in which the value of coefficient of variation of volume-base distribution and the number proportion of toner particles of 5 μm or smaller are defined. Use of such a toner in a recycle system tends to bring about an increase in number proportion of fine particles and concurrently therewith an increase in ground fog as copying is continued.

With regard to non-magnetic toners, some developers are proposed for the purpose of improving image quality. For example, Japanese Patent Application Laid-open No. 51-3244 discloses a developer mainly composed of a toner having particle diameters of 8 to 12 μm, which is relatively coarse and also contains particles of 5 μm or smaller in an amount of not more than 30% by number and those of 20 μm or larger in an amount of not more than 5% by number. From such characteristics, its particle size distribution is presumed to be broad.

Japanese Patent Applications Laid-open No. 54-72054 and No. 58-129437 also disclose a non-magnetic toner having a sharper particle size distribution than the foregoing, but the definition for the distribution is obscure, and those having a relatively broad distribution can be included. Under such particle size distribution, fine powder or coarse powder may increase as recycling is continued, resulting in poor image characteristics.

Thus, when recycle systems are taken into account, none of the invention hitherto made are unsatisfactory, but it is sought to make further improvements.

SUMMARY OF THE INVENTION

An object of the present invention is to provide an image forming method that solves the problems discussed above.

Another object of the present invention is to provide an image forming method suited to a recycle system in which the untransferred toner is reused.

Still another object of the present invention is to provide an image forming method that can obtain consistently sharp images on a large number of copy sheets due to little change of particle diameter of a toner.

A further object of the present invention is to provide an image forming method that can maintain a consistently high reflection image density and may cause no ground fog or toner scatter when used in a recycle system.

The present invention provides an image forming method comprising;

forming a toner image by developing through a developing means a latent image formed on a latent image bearing member;

transferring the toner image formed, from the latent image bearing member to a transfer medium through a transfer means to which a bias is applied;

cleaning the latent image bearing member from which the toner image has been transferred to the transfer medium, to recover or collect the toner remaining on the latent image bearing member; and feeding the toner recovered or collected to said developing means for reuse in the developing step;

wherein said toner comprises a binder resin and at least one of a magnetic powder and a colorant, said toner having;

a weight average particle diameter ($D_4$) of from 4 $\mu$m to 11 $\mu$m;

a coefficient A of variation of number-base distribution, of not more than 40, which is a coefficient represented by the formula:

$$A=S_n/D_1\times 100$$

wherein $S_n$ represents a standard deviation of number-base distribution, and $D_1$ represents a length average particle diameter ($\mu$m) on the basis of number; and a coefficient B of variation of volume-base distribution, of not more than 30, which is a coefficient represented by the formula:

$$B=S_W/D_4\times 100$$

wherein $S_W$ represents a standard deviation of volume-base distribution, and $D_4$ represents a weight average particle diameter ($\mu$m) on the basis of weight.

DESCRIPTION OF THE PREFERRED EMBODIMENTS

Figure 1:
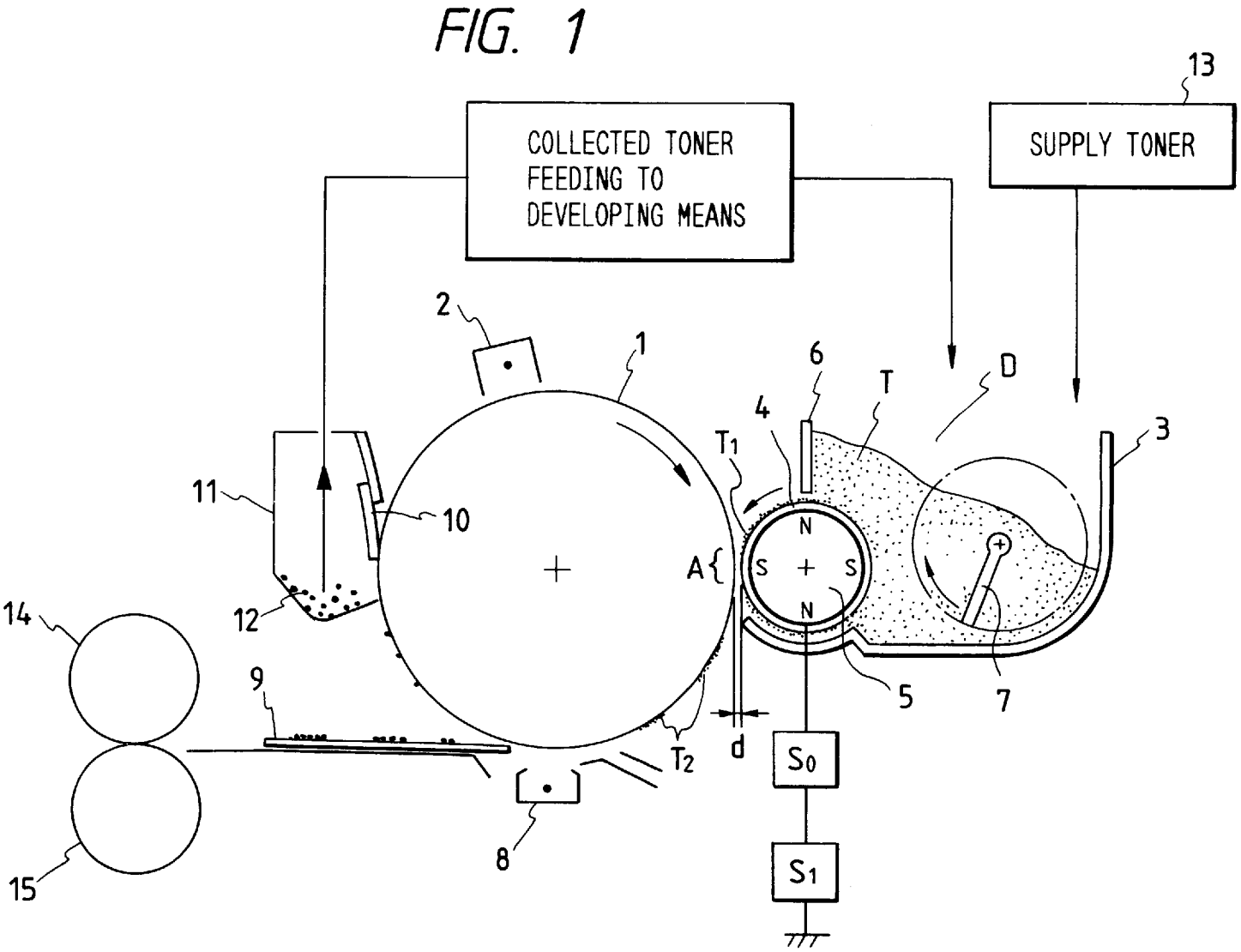
FIG. 1 is a schematic illustration of an embodiment of the image forming apparatus employing a magnetic toner, having a recycle system in which a magnetic toner recovered or collected is recycled and reused, which apparatus is used to carry out the image forming method of the present invention.

The present invention will be described below in detail.

With regard to high-speed copying machines, there is recently an increasing demand therefor. To meet such a demand, it has been attempted to increase copy volume by using copying machines of a higher speed. Thus, with an increase in the copy volume, the quantity of the toner consumed increases, concurrently resulting in an increase in the quantity of the toner untransferred (i.e., waste toner). Hitherto, the untransferred toner is scraped off by a cleaning means such as a cleaning blade, and is then sent to a cleaner chamber or a collecting chamber and discharged out of the system, that is it has not been reused. The reason therefor is that, when the waste toner is reused, there have been difficulties such that the reflection image density decreases, ground fog and reversal fog increase and toner scatter occurs.

Now, to examine the causes of such difficulties, the present inventors have tried collecting the toner on a developing sleeve at all times from the start of copying, to measure various physical properties. As a result, a difference in particle size distribution of the toner was seen around the time on which the above difficulties begin to occur.

It was found that, with a decrease in reflection image density and an increase in fog, the particle size distribution of the toner on the developing sleeve becomes broader, accompanied with an increase in both particles with fine particle diameter and particles with coarse particle diameter.

The present inventors made extensive studies on the reason therefor to reveal that toner with a fine particle diameter and toner with a coarse particle diameter in the toner having participated in the development on the latent image bearing member are not transferred to the transfer medium, are collected in the collecting chamber as untransferred toner, and again are fed into the developing assembly and used in the developing step.

The toner with such particle diameters has a charge retention different from the toner used at the start. Hence, when it participates in development, it causes fog or toner scatter and also the quantity of the toner that can participate in development on the latent image bearing member decreases to cause a decrease in reflection image density.

Then, to solve such problems, the present inventors made further studies to find that it is effective to employ the following toner and image forming method.

With regard to toner being used (start toner), they took note of its particle size distribution, and have discovered that it is effective to make "breadth of distribution" smaller. They have also found that it is a very reliable method to use a coefficient of variation (i.e., a value obtained by dividing a standard deviation of particle size distribution by an average value) as a measure for defining this "breadth of distribution".

The toner that can be used in the image forming method of the present invention is a toner having a weight average particle diameter ($D_4$) of from 4 to 11 $\mu$m. Within the scope of such a toner, is a toner in which a coefficient A of variation of number-base distribution is not more than 40, which is a coefficient represented by the formula:

$$A=S_n/D_1\times 100$$

wherein $S_n$ represents a standard deviation of number-base distribution, and $D_1$ represents a length average particle diameter ($\mu$m) on the basis of number, and also a coefficient B of variation of volume-base distribution is not more than 30, which is a coefficient represented by the formula:

$$B=S_W/D_4\times 100$$

wherein $S_W$ represents a standard deviation of volume-base distribution, and $D_4$ represents a weight average particle diameter ($\mu$m) on the basis of weight.

If the value of A is more than 40 or the value of B is more than 30, toner particles tend to agglomerate with one another particularly in the case of a magnetic toner as recycling is continued, because of the presence of relatively large or small particles with respect to average particle diameter, resulting in the occurrence of toner masses with larger particle diameters than the original toner (start toner or supply toner) to bring about a poor image quality of transferred images. The toner with such particle size distribution, irrespective of whether it is a magnetic toner or a non-magnetic toner, may also cause a poor charge balance of toner particles, so that excessively charged toner particles with a small particle diameter tend to be electrostatically attracted onto the developing sleeve (also onto carrier surfaces in the case of two-component developers) as recycling is continued. This may cause difficulties such that normal toner is inhibited from being carried on the developing sleeve or from being charged, and the toner layer is covered with insufficiently charged toner with larger particle diameters, resulting in a lowering of developability, an increase in fog and a decrease in image density.

If the weight average particle diameter ($D_4$) of the toner is larger than 11 $\mu$m, then the resolving power of the toner may be lowered. If the weight average particle diameter ($D_4$) of the toner is smaller than 4 $\mu$m, the toner may have too large an agglomeration force for the recovered or collected toner to be smoothly and easily transported to a toner hopper or a developer container.

The toner may preferably have a weight average particle diameter ($D_4$) of from 4 to 8 $\mu$m.

In the present invention, the supply toner may preferably have a coefficient A of variation of number distribution, of from 20 to 40, and more preferably from 25 to 35, and a coefficient B of variation of volume-base distribution, of from 15 to 30, and more preferably from 15 to 28.

In the image forming method of the present invention, the collected toner that is collected in the cleaning step and returned to the toner hopper or developer container may preferably have a coefficient A of variation of number-base distribution, of from 25 to 45, and more preferably from 25 to 40, and a coefficient B of variation of volume-base distribution, of from 15 to 35, and more preferably from 20 to 35.

In addition, the ratio of coefficient A(R) of variation of number-base distribution of the collected toner to coefficient A(S) of variation of number-base distribution of the supply toner, A(R)/A(S), may preferably be from 0.95 to 1.3, and the ratio of coefficient B(R) of variation of volume-base distribution of the collected toner to coefficient B(S) of variation of volume-base distribution of the supply toner, B(R)/B(S), may preferably be from 0.95 to 1.3.

The collected toner may also preferably have, in a histogram of number-base distribution thereof, 15% by number or more, and preferably 20% by number or more, of a top peak and a second peak each.

In addition, the collected toner and the supply toner may preferably be in the same region in regard to the particle diameter region of the top peak and second peak in a histogram of volume-base distribution of the former and the particle diameter region of the top peak and second peak in a histogram of volume-base distribution of the latter, and also the collected toner may preferably have, in a histogram of volume-base distribution thereof, 20% by volume or more, and preferably 25% by volume or more, of a top peak and a second peak each.

When the above conditions are fulfilled, good developed images can be formed on a large number of sheets even if an image forming apparatus having a recycle system is used and the collected toner and the supply toner are mixely used, since the particle size distribution of the collected toner has a preferable value.

Herein, the particle size distribution can be measured by various methods. In the present invention, it is measured using a Coulter counter.

A Coulter counter Type TA-II (manufactured by Coulter Electronics, Inc.) is used as a measuring device. An interface (manufactured by Nikkaki k.k.) that outputs number-base distribution and volume-base distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Volume-base distribution and number-base distribution of toner particles of 2 $\mu$m to 40 $\mu$m are measured on the basis of the volume and number of the toner particles by means of the above Coulter counter Type TA-II, using an aperture of 100 $\mu$m as its aperture. Then the values according to the present invention are determined, which are the weight average particle diameter on the basis of weight as determined from the volume-base distribution (a central value of each channel is regarded as a representative value for each channel) and the standard deviation thereof, and the length average particle diameter on the basis of number as determined from the number-base distribution and the standard deviation thereof.

The untransferred toner can be scraped off by a cleaning means from the latent image bearing member by a method including cleaning by an elastic blade, cleaning by an elastic roller, wedge cleaning, fur brush cleaning, magnetic brush cleaning, or any combination of these. In the present invention, any method can be preferably used. It is preferred to use a cleaning method carried out using an elastic blade.

As a method by which the untransferred toner having been scraped off by a cleaning means is reused, there is a method in which the toner having been scraped off by a cleaning means is returned to a hopper holding a supply toner and is sent to the developing assembly after it has been lightly agitated, and a method in which it is directly sent to the developing assembly. In the present invention, any method can be preferably used.

As the toner used in the present invention, a toner constituted in the following manner is preferably used. As a toner binder (a binder resin), the following toner binder resins can be used in the case where a heat-pressure roller fixing device having an oil applicator is used.

For example, usable ones are homopolymers of styrene or derivatives thereof such as polystyrene, poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl $\alpha$-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-acrylonitrile-isoprene copolymer and a styrene-acrylonitrile-indene copolymer;

polyvinyl chloride, phenol resins, natural resin modified maleic acid resin, natural resin modified phenol resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins.

In a heat-pressure roller fixing system to which oil is lightly applied, the preventing of the offset-phenomenon in which part of the toner image on a toner image bearing member transfers to the roller and the adhesion of toner to the transfer medium are important problems. Toners capable of being fixed at less heat energy are usually subject to blocking or caking during storage or in a developing assembly and therefore these problems must be taken into account at the same time. These phenomenons are most greatly concerned with physical properties of the binder resin in the toner. According to researches made by the present inventors, the adhesion of the toner to the transfer medium during fixing is improved when the content of a magnetic material in the toner is decreased, but the offset tends to occur and also the blocking or caking tends to be caused. Hence, in the case when the heat-pressure roller fixing system to which oil is lightly applied is used in the present invention, it is more important to select binder resins. Preferable binder materials include cross-linked styrene copolymers or cross-linked polyesters.

Comonomers copolymerizable with styrene monomers in styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. These may be used alone or in combination of two or more.

Here, as a cross-linking agent, compounds having at least two polymerizable double bonds may be used, including aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds as exemplified by divinyl aniline, divinyl ether, divinyl sulfide and divinyl sulfone; and compounds having at least three vinyl groups. These may be used alone or in the form of a mixture.

In use of a pressure fixing system, binder resins for pressure-fixing toner can be used, as exemplified by polyethylene, polypropylene, polymethylene, polyurethane elastomers, an ethylene-ethyl acrylate copolymer, an ethylene-vinyl acetate copolymer, ionomer resins, a styrene-butadiene copolymer, a styrene-isoprene copolymer, linear saturated polyesters, and paraffin.

In the toner used in the present invention, a charge control agent may preferably be used by compounding it into toner particles (internal addition) or blending it with toner particles (external addition). The charge control agent enables control of optimum electrostatic charges in conformity with developing systems. Particularly in the present invention, it can make more stable the balance between particle size distribution and charging. Thus, use of the charge control agent can make clearer both the function separation for making image quality higher for each particle diameter range described above and the mutually supplementary performance.

A positive charge control agent may include Nigrosine and products modified with a fatty acid metal salt; quaternary ammonium salts such as tributylbenzylammonium 1-hydroxy-4-naphthosulfonate and tetrabutylammonium teterafluoroborate; diorganotin oxides such as dibutyltin oxide, dioctyltin oxide and dicyclohexyltin oxide; and diorganotin borates such as dibutyltin borate, dioctyltin borate and dicyclohexyltin borate; any of which may be used alone or in combination of two or more kinds. Of these, charge control agents such as Nigrosine type compounds or organic quaternary ammonium salts may particularly preferably be used.

Homopolymers of monomers represented by the formula:

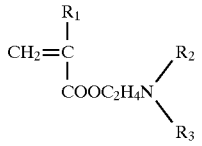

wherein $R_1$ represents H or $CH_3$, and $R_2$ and $R_3$ each represent a substituted or unsubstituted alkyl group, preferably $C_1$ to $C_4$;

or copolymers of polymerizable monomers such as styrene, acrylates or methacrylates as described above may also be used as positive charge control agents. In this case, these charge control agents can also act as binder resins (as a whole or in part).

As a negative charge control agent usable in the present invention, for example, organic metal compounds and chelate compounds are effective, as exemplified by aluminumacetylacetonato, iron (II) acetylacetonato and chromium 3,5-di-tert-butylsalicylate. In particular, acetylacetone metal complexes, monoazo metal complexes, and naphthoic acid type or salicylic acid type metal complexes, or salts thereof are preferred. Salicylic acid type metal complexes, monoazo metal complexes or salicylic acid type metal salts are particularly preferred.

The charge control agents described above (those having no action as binder resins) may preferably be used in the form of fine particles. In this case, the charge control agent may preferably have a number average particle diameter of specifically 4 $\mu$m or less, and more preferably 3 $\mu$m or less.

When internally added to the toner, such a charge control agent may preferably be used in an amount of from 0.1 part to 20 parts by weight, and more preferably from 0.2 part to 10 parts by weight, based on 100 parts by weight of the binder resin.

Fine silica powder may preferably be added to the toner used in the present invention in order to improve charge stability, developability, fluidity and durability.

As the fine silica powder used in the present invention, a fine silica powder having a surface specific area, as measured by the BET method using nitrogen absorption, of not less than 30 m2/g, and particularly in the range of from 50 to 400 $m^2/g$, can give good results. The fine silica powder should preferably be used in an amount of from 0.01 part to 8 parts by weight, and more preferably from 0.1 part to 5 parts by weight, based on 100 parts by weight of the magnetic toner.

For the purpose of making the powder hydrophobic and controlling chargeability, the fine silica powder used in the present invention may also preferably have been treated, if necessary, with silicone varnish, a variety of modified silicone varnish, silicone oil, a variety of modified silicone oil, a silane coupling agent, a silane coupling agent having a functional group or other treating agent such as an organic silicon compound, or with various treating agents used in combination.

Other additives may include, for example, lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); fluidity-providing agent such as titanium oxide, aluminum oxide, hydrophobic titanium oxide and hydrophobic aluminum oxide (in particular, hydrophobic titanium oxide is preferred); anti-caking agents; conductivity-providing agents such as carbon black, zinc oxide, antimony oxide and tin oxide; and developability improvers such as white fine powder or black fine powder with a polarity reverse to that of the toner. These can be used in a small amount.

For the purpose of improving releasability at the time of heat roll fixing, it is one of preferred embodiments of the present invention to add a waxy substance such as a low-molecular-weight polyethylene, a low-molecular-weight polypropylene, microcrystalline wax, carnauba wax, sazole wax or paraffin wax to the magnetic toner in an amount of from 0.5 to 10% by weight based on 100% by weight of the binder resin.

The colorant that can be used in the present invention may include any suitable pigments and dyes. For example, the pigments include carbon black, Aniline Black, acetylene black, Naphthol Yellow, Hanza Yellow, Rhodamin Lake, alizarin lake, red iron oxide, Phthalocyanine Blue and Indanthrene Blue. Any of these may be used in an amount necessary and sufficient for maintaining optical density of fixed images, and should be added in an amount of from 0.1 part to 20 parts by weight, and preferably from 2 to 10 parts by weight, based on 100 parts by weight of the resin. Dyes are used for the same purpose. They include, for example, azo dyes, anthraquinone dyes, xanthene dyes and methine dyes, any of which should be added in an amount of from 0.1 part to 20 parts by weight, and preferably from 0.3 part to 3 parts by weight, based on 100 parts by weight of the resin.

In the case when the toner of the present invention is a magnetic toner, it contains a magnetic material, which may also serve as a colorant. The magnetic material contained in the magnetic toner may include iron oxides such as magnetite, hematite and ferrite; and metals such as iron, cobalt and nickel or alloy of any of these metals with a metal such as aluminum, copper, lead, magnesium, tin, zinc, antimony, beryllium, bismuth, cadmium, calcium, manganese, selenium, titanium, tungsten or vanadium, and mixtures of any of these.

These ferromagnetic materials may preferably be those having an average particle diameter of from 0.1 to 2 $\mu$m, and more preferably from 0.1 to 0.5 $\mu$m. Any of these materials should be contained in the magnetic toner in an amount of from 20 to 200 parts by weight, and particularly preferably from 40 to 150 parts by weight, based on 100 parts by weight of the resin component.

They may preferably be those having a coercive force of from 20 to 150 oersteds, a saturation magnetization of from 50 to 200 emu/g and a residual magnetization of from 2 to 20 emu/g as magnetic properties under application of 10K oersteds.

In the case when the toner of the present invention is a non-magnetic toner that uses a carrier in combination, the carrier that can be used may include, powders having magnetism as exemplified by iron powder, ferrite powder and nickel powder, and those obtained by treating particle surfaces of these materials with resin or the like. The carrier should be used in an amount of from 10 to 1,000 parts by weight, and preferably from 30 to 500 parts by weight, based on 10 parts by weight of the toner. The carrier may have a particle diameter of from 4 to 100 $\mu$m, preferably from 10 to 80 $\mu$m, and more preferably from 20 to 60 $\mu$m, which is preferable in view of its matching to toners with a small particle diameter.

The carrier used in the present invention in order to make the toner used in the present invention participate in development may preferably be coated with a resin and/or a silicone compound.

The toner having the particle size distribution of the present invention tends to contaminate the surfaces of carrier particles, and hence the carrier particle surfaces may preferably be coated with a resin also in order to prevent such contamination.

Such carrier coated with a resin is advantageous also for durability when used in high-speed machines. The carrier can be coated also for the purpose of charge control of the toner.

As the resin used to form the coating layer of the carrier, for example, silicone resins, silicone compounds and fluorine resins can be preferably used.

The fluorine resins preferably usable to form the coating layer of the carrier are exemplified by halofluoropolymers such as polyvinyl fluoride, polyvinylidene fluoride, polytrifluoroethylene and polytrifluorochloroethylene; polytetrafluoroethylene, polyperfluoropropylene, a copolymer of vinylidene fluoride with an acrylic monomer, a copolymer of vinylidene fluoride with trifluorochloroethylene, a copolymer of tetrafluoroethylene with hexafluoropropylene, a copolymer of vinyl fluoride with vinylidene fluoride, a copolymer of vinylidene fluoride with tetrafluoroethylene, a copolymer of vinylidene fluoride with hexafluoroethylene, and fluoroterpolymers such as a terpolymer of tetrafluoroethylene with vinylidene fluoride and a non-fluorinated monomer.

The fluorine polymer resin should preferably have a weight average molecular weight of from 50,000 to 400,000, and preferably from 100,000 to 250,000.

To form the coating layer of the carrier, the fluorine resins as described above may each be used alone or may be used in the form of a blend of any of these. Blends to which other polymers have been further blended may also be used.

As above, other polymers, homopolymers or copolymers of monomers as shown below are used.

They include vinyl monomers having a vinyl group in the molecule, as exemplified by styrene, styrene derivatives such as $\alpha$-methylstyrene, p-methylstyrene, p-t-butyl-styrene and p-chlorostyrene, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxyethyl methacrylate, propoxyethyl methacrylate, butoxyethyl methacrylate, methoxydiethylene glycol methacrylate, ethoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyethyl methacrylate, N-vinyl-2-pyrrolidone methacrylate, methacrylonitrile, methacrylamide, N-methylolmethacrylamide, ethylmorpholine methacrylate, diacetoneacrylamide, methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, methoxyethyl acrylate, propoxyethyl acrylate, butoxyethyl acrylate, methoxydiethylene glycol acrylate, ethoxydiethylene glycol acrylate, methoxyethylene glycol acrylate, butoxytriethylene glycol acrylate, methoxydipropylene glycol acrylate, phenoxyethyl acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, glycidyl acrylate, acrylonitrile, acrylamide, N-methylolacrylamide, diacetoneacrylamide, ethylmorpholine acrylate and vinylpyridine; acrylic monomers having two or more vinyl groups in the molecule as exemplified by divinylbenzene, reaction products of glycol with methacrylic acid or acrylic acid, as exemplified by ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, polyethylene glycol dimethacrylate, tripropylene glycol dimethacrylate, hydroxypivalic acid neopentyl glycol ester dimethacrylate, trimethylolethane trimethacrylate, trimethylolpropane trimethacrylate, pentaerythritol tetramethacrylate, trismethacryloxyethyl phosphate, tris (methacryloyloxyethyl) isocyanurate, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, polyethylene glycol diacrylate, tripropylene glycol diacrylate, hydroxypivalic acid neopentyl glycol diacrylate, trimethylolethane triacrylate, trimethylolpropane triacrylate, pentaerythritol tetraacrylate, trisacryloxyethyl phosphate and tris (acryloyloxyethyl) isocyanurate, half-esterification products of glycidyl methacrylate with methacrylic acid or acrylic acid, half-esterification products of bisphenol type epoxy resin with methacrylic acid or acrylic acid, and half-esterification products of glycidyl acrylate with methacrylic acid or acrylic acid; and acrylic monomers having a hydroxyl group as exemplified by 2-hydroxyethyl acrylate, 2-hydroxypropyl acrylate, hydroxybutyl acrylate, 2-hydroxy-3-phenyloxypropyl acrylate, 2-hydroxyethyl methacrylate, 2-hydroxypropyl methacrylate, hydroxybutyl methacrylate, 2-hydroxy-3-phenyloxypropyl methacrylate.

These vinyl monomers are copolymerized by known processes such as suspension polymerization, emulsion polymerization and solution polymerization. The resulting copolymers may preferably have a weight average molecular weight of from 10,000 to 70,000. The copolymers may be also subjected to melamine aldehyde cross-linking or isocyanate cross-linking.

The fluorine resin and other polymer may preferably be blended in a ratio of 20 to 80:80 to 20% by weight, and particularly 40 to 60:60 to 40% by weight.

As the silicone resin or silicone compound used to form the coating layer of the carrier, polysiloxanes as exemplified by dimethyl polysiloxane and phenylmethyl polysiloxane are used. It is also possible to use modified resins such as alkyd-modified silicone, epoxy-modified silicone, polyester-modified silicone, urethane-modified silicone and acryl-modified silicone.

As the form of modification, block copolymers, graft copolymers, comb-type graft polysiloxanes, etc. can be used.

When they are actually applied to the surfaces of magnetic particles, a method is employed in which a silicone resin is previously converted into varnish as exemplified by solid methyl silicone varnish, solid phenyl silicone varnish, solid methylphenyl silicone varnish, solid ethyl silicone varnish and various types of modified silicone varnishes, and the magnetic particles are dispersed therein, or a method in which the varnish is sprayed on the magnetic particles.

As a core material of the carrier used in the present invention, for example, surface-oxidized or -unoxidized metals such as iron, nickel, cobalt, manganese, chromium or rare earth elements and also alloys or oxides thereof can be used. Metal oxide particles can be preferably used, and magnetic ferrite particles can be more preferably used.

The carrier should be those having an average particle diameter of from 4 to 100 $\mu$m, and preferably from 10 to 50 $\mu$m.

If the carrier has an average particle diameter smaller than 4 $\mu$m, then the carrier tends to be developed on (i.e., transferred together with toner to) the latent image bearing member, tending to scratch the latent image bearing member or the cleaning blade. If, on the other hand the carrier has an average particle diameter larger than 100 $\mu$m, then the toner-holding ability of the carrier may be lowered, tending to cause uneven solid images, toner scatter and fog. Such a carrier core material may be comprised of only a magnetic material or may be comprised of a combination of a magnetic material and a non-magnetic material. It may also be a mixture of two or more kinds of magnetic particles.

The surface of the above carrier core material may be coated with the above coating resin preferably by a method in which the resin is dissolved or suspended in a solvent and the solution or suspension is coated on core surfaces so that the resin adheres to the core comprised of magnetic particles.

The treatment with the coating resin may preferably be in an amount usually of from 0.1 to 30% by weight, and preferably from 0.5 to 20% by weight, based on the weight of the carrier core material in total weight, in view of film forming properties or durability of the coating material.

The toner according to the present invention can be produced in the following way: A vinyl type or non-vinyl type thermoplastic resin, a magnetic powder or a pigment or dye, a charge control agent and other additives are thoroughly mixed using a mixing machine such as a ball mill, and then the mixture is melt-kneaded using a kneading machine such as a heating roll, a kneader or an extruder to make the resin and so on melt with one another, in which a pigment or dye is then dispersed or dissolved, followed by cooling for solidification and thereafter pulverization and strict classification. Thus, the toner according to the present invention can be obtained.

The toner of the present invention must be particularly strictly classified. For this purpose, the pulverizing step also is important and, in order to carry out strict classification, the particle size distribution of the finely pulverized product must be kept as sharp as possible. For this purpose, the kneaded product may preferably be previously crushed in a diameter of 2 mm or less, preferably 1 mm or less, and more preferably 0.5 mm or less before the pulverization is carried out. It is particularly preferable to insert a median pulverizing step to pulverize the crushed product to a diameter of 10 to 100 μm, followed by fine pulverization.

The pulverized product with such a small particle diameter is finely pulverized so that the particle size distribution of the finely pulverized product can be made sharp. This makes it possible to make strict classification in the classification step to give the particle size distribution characterized in the present invention.

The toner according to the present invention may preferably be applied to an image forming method in which an image is developed while causing the toner to fly from a toner carrying member such as a cylindrical sleeve to a latent image bearing member such as a photosensitive member. The toner is triboelectrically charged mainly upon its friction with the sleeve surface, and is coated in a thin layer on the sleeve surface. The thin layer of the toner is formed in a thickness smaller than the gap between the photosensitive member and the sleeve in the developing zone. When the latent image on the photosensitive member is developed, the toner having a tribo-electricity should be caused to fly from the sleeve to the photosensitive member while applying an alternating electric field across the photosensitive member and the sleeve.

The alternating electric field is exemplified by a pulse electric field, an AC bias or an AC/DC bias overlapping field.

Quite satisfactory images can be obtained when an absolute value of AC bias voltage is 1.0 kV or more. Also taking account of a leak to the latent image bearing member, the absolute value of the AC bias voltage may preferably be 1.0 kV or more to 2.0 kV or less. As a matter of course, however, this leak varies depending on the gap between the developing sleeve and the latent image bearing member.

Then the AC bias frequency may preferably be 1.0 kHz to 5.0 kHz. When the frequency is lower than 1.0 kHz, gradation is improved but it becomes difficult to eliminate ground fog. This is presumed to be due to the fact that, in a low-frequency region in which the toner reciprocates few times, the bias electric field on the development side can produce an excessively strong force of pressing the toner against the latent image bearing member even in a non-image area and hence the toner having adhered to the non-image area can not be completely removed even by a toner take-off force produced by a bias electric field on the reverse development side. If the frequency is higher than 5.0 kHz, it follows that the bias electric field on the reverse development side is applied before the toner comes into good contact with the latent image bearing member, resulting in an extreme lowering of developability to make it impossible for the toner itself to respond to a high-frequency electric field.

In particular, optimum image characteristics are exhibited when the frequency of the alternating bias electric field is 1.5 kHz to 3 kHz.

Figure 11:
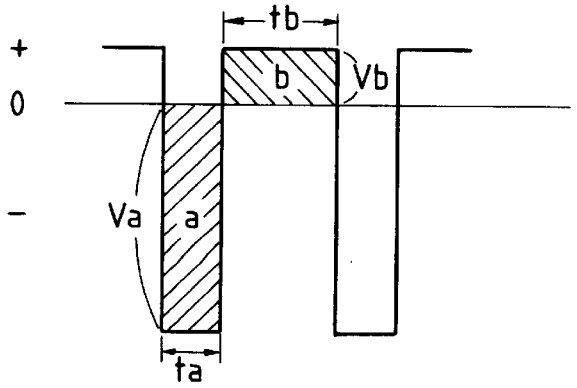
FIG. 11 illustrates an asymmetrical bias.

It is also preferable to use as the alternating electric field an asymmetrical bias as shown in FIG. 11. In the asymmetrical bias shown in FIG. 11, the part a is a bias component on the development side and the part b is a bias component on the reverse development side. The magnitude of the bias component on the development side and that of the bias component on the reverse development side are represented by absolute values of Va and Vb, respectively.

Duty ratio in the alternating bias electric field is defined as shown in the following expression.

$$\text{Duty ratio}=[ta/(ta+tb)]\times 100(\%)$$

wherein ta represents a time for which a polar component (that constitutes the bias component a on the development side) is applied in the direction of the toner moved to the latent image bearing member, in a period corresponding to one period of the alternating bias whose electric-field polarity is positive-negative periodically changed, and tb represents a time for which a polar component (that constitutes the bias component b on the reverse development side) is applied in the direction in which the toner is drawn apart from the latent image bearing member.

The duty ratio that satisfies an alternating bias electric field waveform may be less than 50%. Taking account of image characteristics, it should be 10%≦duty ratio≦40%. If the duty ratio is more than 40%, then image quality can be less effectively made higher. If the duty ratio is less than 10%, then the alternating bias electric field response of the toner itself as stated above may become poor, thereby causing a lowering of developability. In particular, an optimum value of the duty ratio is 15%≦duty ratio ≦35%.

As the alternating bias electric field waveform, waveforms of shortwave, sine wave, sawtooth wave, triangular wave or the like can be applied.

The image forming method of the present invention will be specifically described below with reference to the accompanying drawings.

FIG. 1 is a schematic illustration of an embodiment of the image forming method employing a one-component magnetic toner.

As shown in FIG. 1, an electrostatic image bearing member 1 (e.g., an amorphous silicon drum or an OPC photosensitive drum) is electrically charged by means of a charging means 2 such as a corona assembly, and is exposed to analog light or digital light, whereupon an electrostatic latent image is formed thereon. The electrostatic image bearing member 1 is rotated in the direction of an arrow.

Reference symbol D denotes the whole of a developing assembly. Reference numeral 3 denotes a developer container that holds the toner; 4, a rotating cylinder (hereinafter "developing sleeve 4") serving as a toner carrying member (a developer layer supporting member), having in its inside a magnetic field generating means 5 such as a magnetic roller.

The developing sleeve 4 is rotatably supported on a shaft in such a manner that it is thrust into the developer container 3 by substantially the right half, as viewed in the drawing, of its periphery and is exposed to the outside of the developer container by substantially the left half of its periphery, is provided at a gap a with respect to the latent image bearing member 1, and is rotated in the direction of an arrow. Reference numeral 6 denotes a doctor blade serving as a toner coating member, provided in such a manner that its lower edge is in proximity to the top surface of the developing sleeve 4; and 7, an agitating member for agitating the toner contained in the developer container 3.

The developing sleeve 4 has an axial line substantially parallel to the normal line of the latent image bearing member and is closely opposed to the surface of the latent image bearing member with a minute gap α between them.

The latent image bearing member 1 and the developing sleeve 4 have substantially the same surface movement speed (peripheral speed), or the developing sleeve 4 has a little higher peripheral speed. A direct voltage and an alternating voltage are overlappingly applied across the latent image bearing member 1 and the developing sleeve 4 by means of an alternating bias voltage applying means $S_0$ and a direct bias voltage applying means $S_1$.

Substantially the right half of the periphery of the developing sleeve 4 always comes into contact with the toner accumulated in the developer container 3, and the magnetic toner present in the vicinity of the sleeve surface is attracted to and held on the surface of the developing sleeve 4 as a magnetically attracted layer by the action of a magnetic force produced by the magnetic field generating means 5 provided inside the sleeve. As the developing sleeve 4 is rotatingly driven, the magnetic toner layer attracted to the sleeve surface is adjusted into a thin-layer magnetic toner layer $T_1$ in the course of its pass through the position of the doctor blade 6. The magnetic toner is electrostatically charged mainly as a result of its frictional contact with the sleeve surface, accompanied with the rotation of the developing sleeve 4. The magnetic toner thin layer surface is rotated toward the surface of the latent image bearing member 1 as the developing sleeve 4 is rotated, and passes a developing zone A that is a zone where the latent image bearing member 1 and the developing sleeve 4 stand closest. In due course the toner layer passes the zone, the toner of the magnetic toner thin layer on the side of the developing sleeve 4 is caused to fly by the alternating and direct electric fields produced by direct and alternating voltages applied across the latent image bearing member 1 and the developing sleeve 4, and reciprocates between the surface of the latent image bearing member 1 and the developing sleeve 4 in the developing zone A. Finally, the magnetic toner on the side of the developing sleeve 4 is selectively transferred and attracted to the surface of the latent image bearing member 1 according to potential patterns of the latent image, and thus magnetic toner images $T_2$ are successively formed.

The developing sleeve surface on which the magnetic toner has been partially consumed after its pass through the developing zone A is again rotated toward the toner accumulated in the developer container 3 and is again supplied with the magnetic toner. Thus, the magnetic toner thin layer $T_1$ on the developing sleeve 4 is always rotated toward the developing zone A, and the developing steps are repeated.

The magnetic toner image $T_2$ formed on the latent image bearing member 1 is transferred to a transfer medium 9 such as plain paper or OHP film through a transfer means 8 such as a corona charger.

The latent image bearing member 1 from which the magnetic toner image $T_2$ has been transferred is cleaned by a cleaning means 10 such as a cleaning blade or a cleaning roller, and the magnetic toner remaining on the latent image bearing member 1 is recovered or collected as a recovered or collected magnetic toner 12 in a collection chamber 11. The collected magnetic toner 12 is fed to the developer container 3 through a feeding means such as a transporting pipe having a delivery screw, where it is mixed with the supply magnetic toner and then reused for development.

The transfer medium 9 having the transferred magnetic toner image $T_2$ is passed through a fixing means such as a heat-pressure roller fixing assembly provided with a heating roller 14 and a pressure roller 15, so that the magnetic toner image $T_2$ is fixed to the transfer medium 9.

In order to make the particle size distribution of the collected toner constant, it is preferable to use a developing sleeve having on its surface brought into contact with the toner a coat layer containing conductive fine particles.

The coat layer used may comprise a film forming polymeric material containing the conductive fine particles. The conductive fine particles may preferably be those having a resistivity of 0.5 Ω.cm or less as a value after pressing at 120 kg/cm The conductive fine particles may preferably include fine carbon particles, a mixture of fine carbon particles with crystalline graphite, and crystalline graphite. The conductive fine particles may also preferably be those having a particle diameter of from 0.005 to 10 μm.

As the graphite, those having a particle diameter of from 0.5 μm to 10 μm are preferable.

As the film forming polymeric material, it is possible to use, for example, thermoplastic resins such as styrene resins, vinyl resins, polyether sulfone resin, polycarbonate resin, polyphenylene oxide resin, polyamide resin, fluorine resin, cellulose resins and acrylic resins; and thermosetting resins or photocurable resins such as epoxy resin, polyester resin, alkyd resin, phenol resin, melamine resin, polyurethane resin, urea resin, silicone resin and polyimide resin. In particular, those having a releasability such as silicone resin and fluorine resin or those having good mechanical properties, such as polyether sulfone, polycarbonate, polyphenylene oxide, polyamide, phenol resin, polyester, polyurethane and styrene resins are preferred. Phenol resins are particularly preferred.

Conductive amorphous carbon may preferably have a particle diameter of from 5 to 100 mμ, preferably from 10 to 80 mμ, and more preferably from 15 to 40 mμ.

The conductive fine particles may preferably be used in an amount of from 3 to 20 parts by weight based on 10 parts by weight of the resin component.

In the case when fine carbon particles and graphite particles are used in combination, the fine carbon particles may preferably be used in an amount of from 1 part to 50 parts by weight based on 10 parts by weight of the graphite.

The resin coat layer in which the conductive fine particles have been dispersed may preferably have a volume resistivity of from $10^{-6}$ to $10^{6}$ Ωcm.

The image forming method of the present invention in which a two-component developer is used will be described below with reference to FIG. 2.

Figure 2:
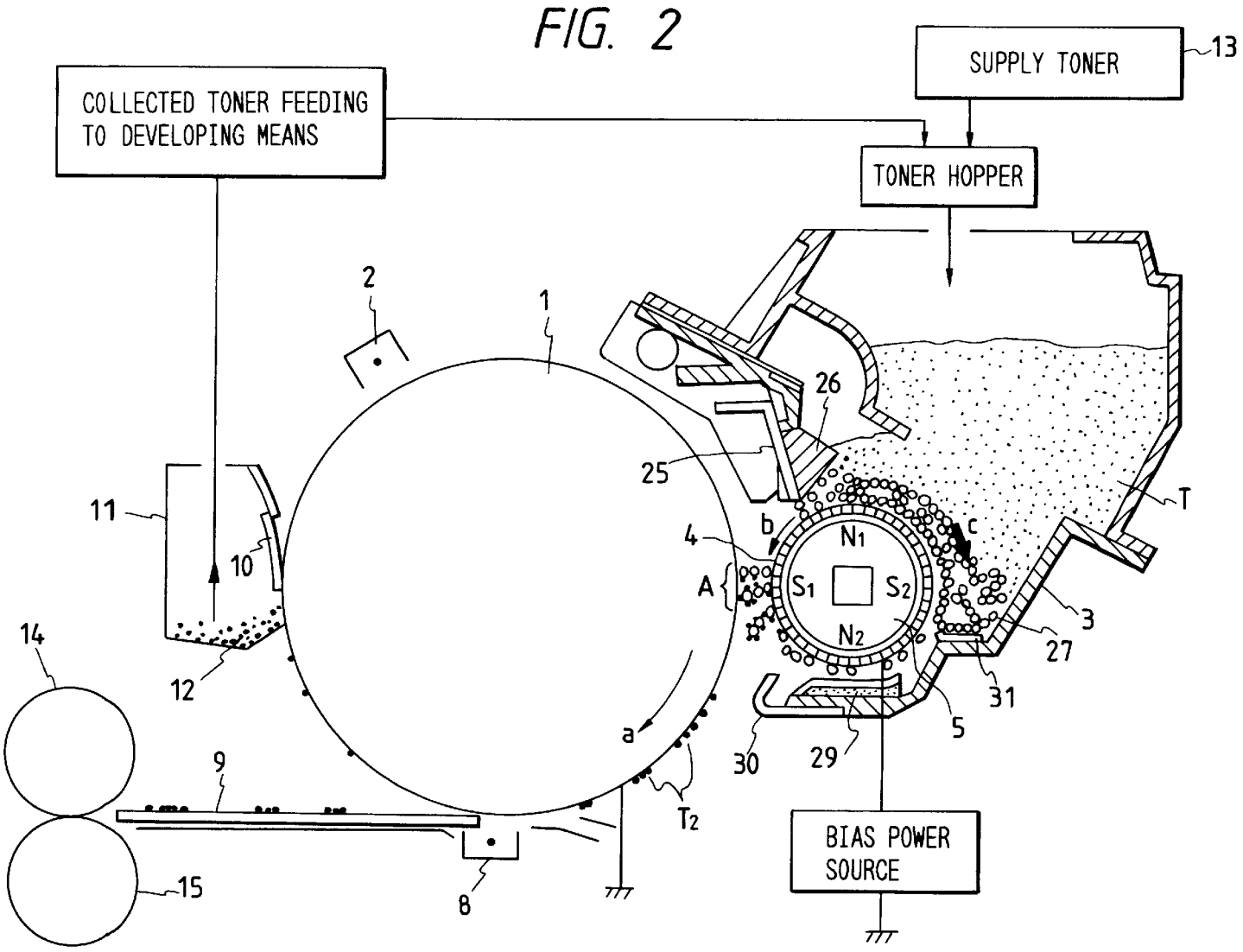
FIG. 2 is a schematic illustration of an embodiment of the image forming apparatus employing a two-component developer, having a recycle system in which a non-magnetic toner collected is recycled and reuse, which apparatus is used to carry out the image forming method of the present invention.

In FIG. 2, reference numeral 1 denotes a latent image bearing member; 3, a developer feeding container; 4, a non-magnetic sleeve; 5, a stationary magnet; 25, a magnetic or non-magnetic blade; 26, a magnetic particle circulation zone limiting member; 27, magnetic particles (magnetic carrier particles); 29, a developer collector container; 30, a scatter preventive member; and 31, a magnetic member. The developing sleeve 4 is rotated in the direction b and, concurrently therewith, its contact and friction with a magnetic particle layer takes place, so that a developer layer is formed on the developing sleeve 4. The magnetic particles 27, while circulating in the direction of c, are partly controlled to a given quantity at a gap between the magnetic or non-magnetic blade 25 and the developing sleeve 4, and coated on the developer layer. The developer is consequently made to be coated on both the surface of the developing sleeve 4 and the surfaces of magnetic particles 27, so that substantially the same effect can be exhibited as a case when the surface area of the sleeve is increased.

In a developing zone A, one polarity of the stationary magnet 5 is set opposingly to the surface of a latent image to form a clear development pole, and an alternating electric field is applied to cause the non-magnetic toner T to fly from the surfaces of the developing sleeve 4 and magnetic particles 27 to develop the latent image. After development, the magnetic particles 27 and the toner having not participated in development is collected in the developer container as the developing sleeve 4 is rotated.

The developing sleeve 4 may be comprised of a paper cylinder or a synthetic resin cylinder. In such cylinders, a cylinder whose surface has been subjected to conductive treatment or is comprised of a conductive material such as aluminum, brass or stainless steel can be used as a development electrode roller.

A non-magnetic toner $T_2$ formed on the latent image bearing member is transferred to a transfer medium 9 through a transfer means 8 such as a corona charger.

The latent image bearing member 1 from which the non-magnetic toner image $T_2$ has been transferred is cleaned by a cleaning means 10, and the non-magnetic toner remaining on the latent image bearing member 1 is recovered or collected as a recovered or collected non-magnetic toner 12 in a collection chamber 11. The collected non-magnetic toner 12 is fed to the developer container 3 through a feeding means such as a transporting pipe having a delivery screw, where it is mixed with the supply non-magnetic toner and also magnetic particles 27 and then reused for development.

The transfer medium 9 having the transferred non-magnetic toner image $T_2$ is passed through a fixing means, so that the non-magnetic toner image $T_2$ is fixed to the transfer medium 9.

The present invention will be described below in greater detail by giving Examples.

In the following formulation, "part(s)" refer to "part(s) by weight" in all occurrences.

EXAMPLE 1

Styrene/butyl acrylate/butyl maleate/divinylbenzene copolymer (copolymerization weight ratio: 73.5:19:7:0.5) 100 parts Magnetic iron oxide (average particle diameter: 0.2 μm) 85 parts Chromium complex of 3,5-di-tert-butylsalicylic acid (number average particle diameter: 2.8 μm) 2 parts Low-molecular-weight propylene-ethylene copolymer 3 parts The above materials were thoroughly premixed using a blender mixer, and then kneaded using a twin-screw kneading extruder set to 150° C. The resulting kneaded product was cooled, and then crushed using a cutter mill. Thereafter, the crushed product was finely pulverized using a fine grinding mill utilizing a jet stream. The resulting finely pulverized product was classified using a fixed wall type air classifier to produce a classified powder. The resulting classified powder was further put in a multi-division classifier utilizing the Coanda effect (Elbow Jet Classifier, manufactured by Nittetsu Kogyo Co.) to strictly classify and remove ultrafine powder and coarse powder at the same time. Thus, a black fine powder (a magnetic toner) with a weight average particle diameter ($D_4$) of 6.65 μm was obtained.

Figure 9:
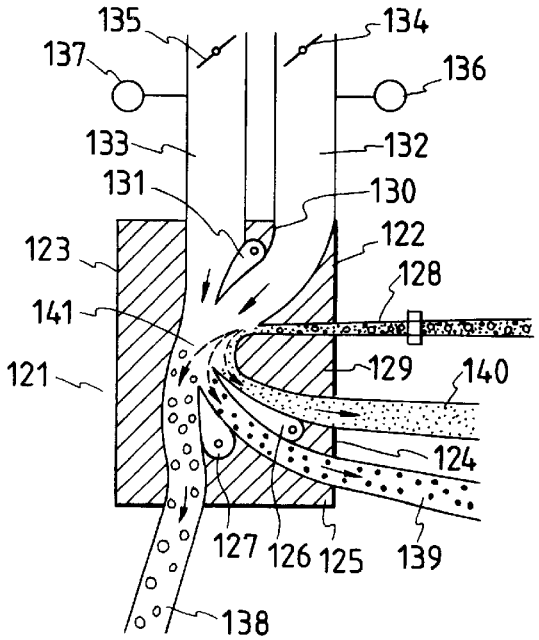
FIGS. 9 and 10 partially illustrate a classifier used when the toner is prepared.
Figure 10:
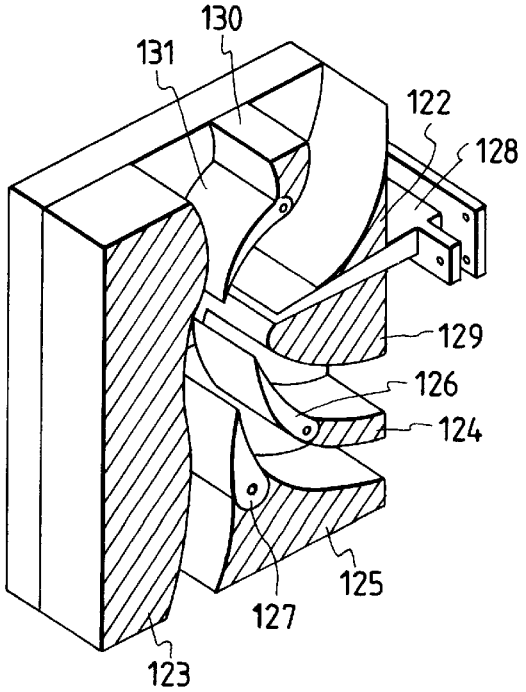

For reference, the classifying step carried out using the multi-division classifier is diagrammatically shown in FIG. 9. A partial cross-sectional perspective view of the multi-division classifier is shown in FIG. 10.

To 100 parts of the magnetic toner thus obtained, 0.6 part of negatively chargeable hydrophobic dry-process silica (BET specific surface area: 240 $m^2/g$) was added, followed by mixing using a Henschel mixer to give a negatively chargeable one-component magnetic toner. This was used as magnetic toner at the start of image reproduction and as supply magnetic toner.

The particle size distribution of this magnetic toner was measured using the Coulter counter Type TA-II having an aperture of 100 μm as previously described, to obtain the data shown in Table 1 below. Here, the length average particle diameter on the basis of number ($D_1$) was 5.63 μm, the standard deviation of number-base distribution ($S_n$) was 1.53, the coefficient of variation of number-base distribution (A) was 27.2, the weight average particle diameter ($D_4$) was 6.65 μm, the standard deviation of volume-base distribution ($S_W$) was 1.39, and the coefficient of variation of volume-base distribution (B) was 20.9.

Figure 5:
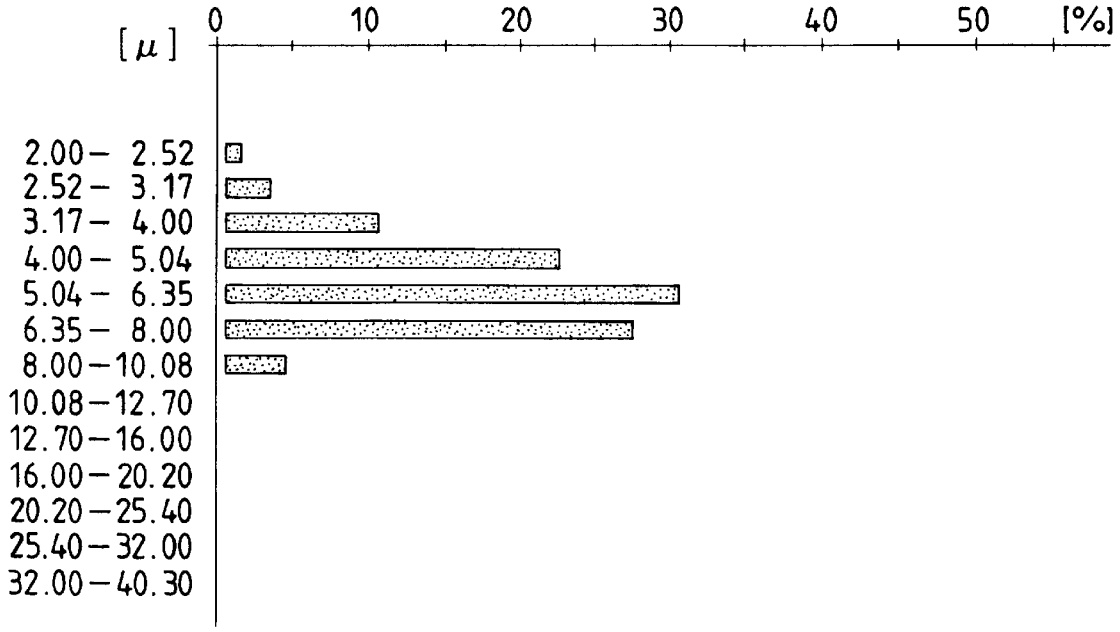
FIG. 5 shows a histogram of number-base distribution of a supply toner as used in Example 1.
Figure 6:
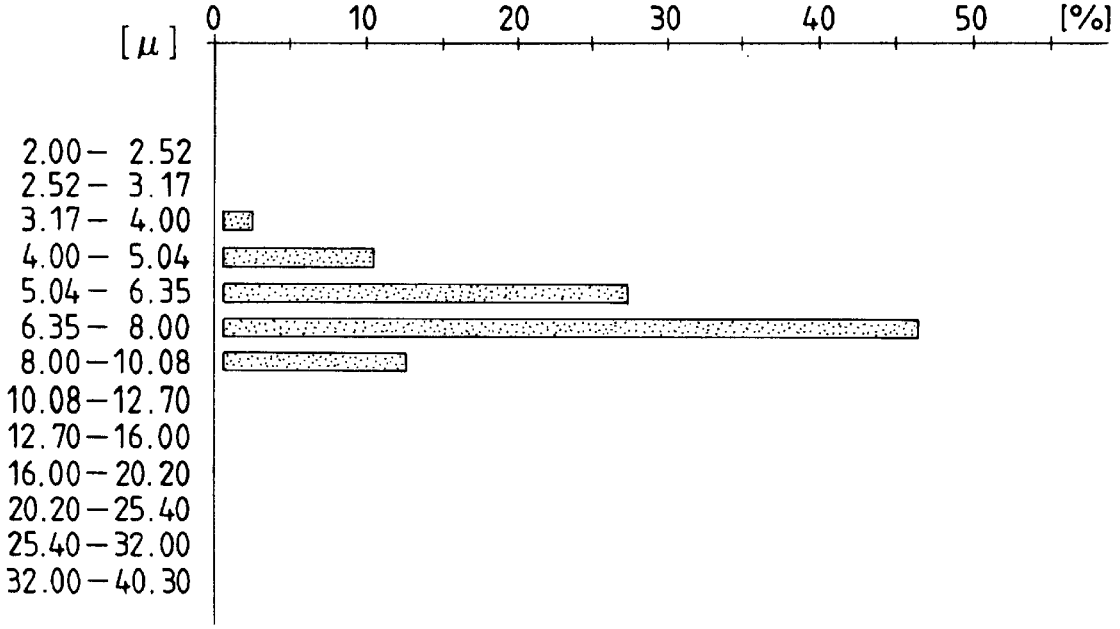
FIG. 6 shows a histogram of volume-base distribution of the supply toner.

A histogram of the number-base distribution of the magnetic toner particles is shown in FIG. 5, and a histogram of the volume-base distribution thereof is shown in FIG. 6.

In the histogram of the number-base distribution in the supply magnetic toner (FIG. 5), a top peak (30.9% by number) was present in the range of particle diameters of from 5.04 to 6.35 μm, and a second peak (27.5% by number) was present in the range of particle diameters of from 6.35 to 8.00 μm.

In the histogram of the volume-base distribution in the supply magnetic toner (FIG. 6), a top peak (46.4% by weight) was present in the range of particle diameters of from 6.35 to 8.00 μm, and a second peak (27.4% by weight) was present in the range of particle diameters of from 5.04 to 6.35 μm.

TABLE 1

| | | Number-base(%) | | Volume-base(%) | |
|---|---|---|---|---|---|
| Size (μm) | Number | Distri-bution | Cumu-lative | Distri-bution | Cumu-lative |
| 2.00–2.52 | 2,139 | 1.8 | 0.9 | 0.0 | 0.0 |
| 2.52–3.17 | 4,003 | 3.3 | 5.0 | 0.3 | 0.3 |
| 3.17–4.00 | 12,221 | 10.0 | 15.0 | 2.4 | 2.7 |
| 4.00–5.04 | 27,062 | 22.2 | 37.2 | 10.3 | 13.0 |
| 5.04–6.35 | 37,769 | 30.9 | 68.1 | 27.4 | 40.4 |
| 6.35–8.00 | 33,516 | 27.5 | 95.6 | 46.4 | 86.7 |
| 8.00–10.08 | 5,278 | 4.3 | 99.9 | 12.9 | 99.6 |
| 10.08–12.70 | 88 | 0.1 | 100 | 0.4 | 100 |
| 12.70–16.00 | 1 | 0.0 | 100.0 | 0.0 | 100.0 |
| 16.00–20.20 | 1 | 0.0 | 100.0 | 0.0 | 100.0 |
| 20.20–25.40 | 2 | 0.0 | 100.0 | 0.0 | 100.0 |
| 25.40–32.00 | 1 | 0.0 | 100.0 | 0.0 | 100.0 |
| 32.00–40.30 | 0 | 0.0 | 100.0 | 0.0 | 100.0 |

Figure 3:
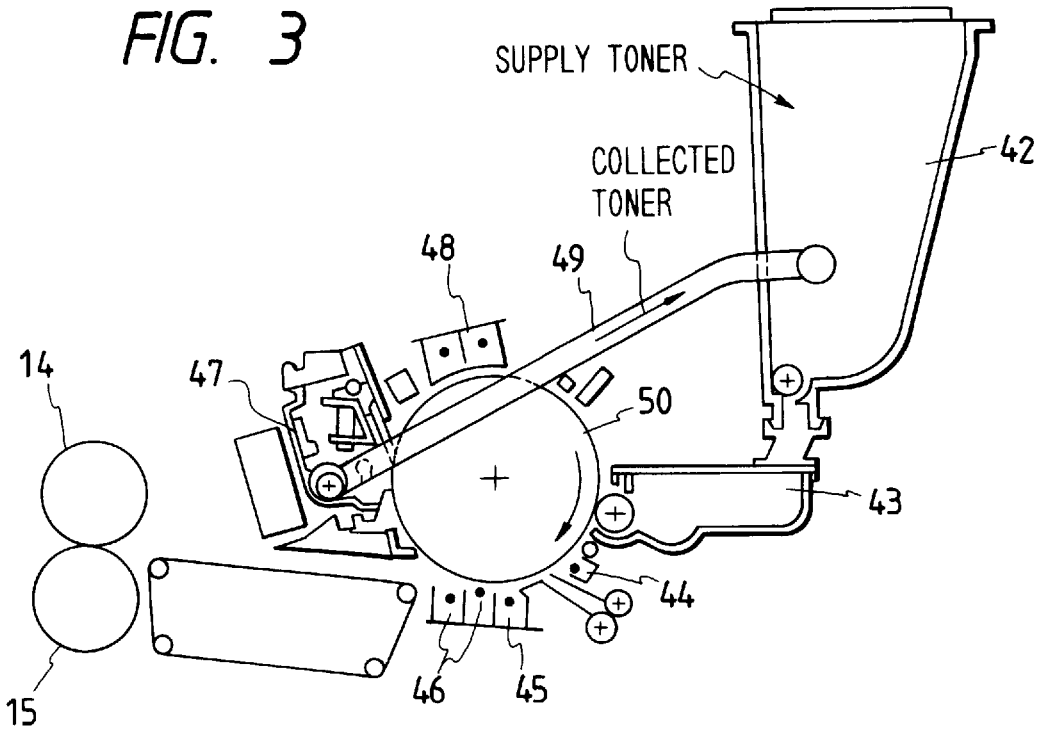
FIG. 3 is a schematic illustration of another embodiment of the image forming apparatus used to carry out the image forming method of the present invention.

The one-component magnetic toner thus prepared was introduced into a modified machine of a copying machine NP5060 (equipped with an amorphous silicon drum), manufactured by Canon Inc., which, as shown in FIG. 3, was so modified for the recovered or collected, untransferred toner (the toner scraped off by a cleaning means) to be returned to a supply toner hopper through a pipe provided in its inside with a delivery screw, to be lightly agitated together with the supply toner held in the hopper and thereafter to be supplied to the developing assembly. A continuous 200,000 sheet image reproduction test was made while the supply magnetic toner was successively supplied.

In FIG. 3, reference numeral 42 denotes a toner supply hopper; 43, a developing assembly having a developing sleeve, a developer container and so forth; 44, a transfer pre-charger; 45, a transfer charger; 46, a separation charger; 47, a cleaner provided with a cleaning blade, a collection chamber and so forth; 48, a primary corona assembly; and 49, a recovered or collected toner transporting pipe having a delivery screw.

The developing assembly 43 has a developing sleeve comprising a metallic sleeve having thereon a surface layer formed of a phenol resin composition containing conductive fine particles (carbon black and graphite). Latent images were developed while applying an asymmetric (duty ratio: 30%) alternating electric field to the developing sleeve.

The images were reproduced at a copying speed of 50 sheets per minute on A4-size paper.

Figure 7:
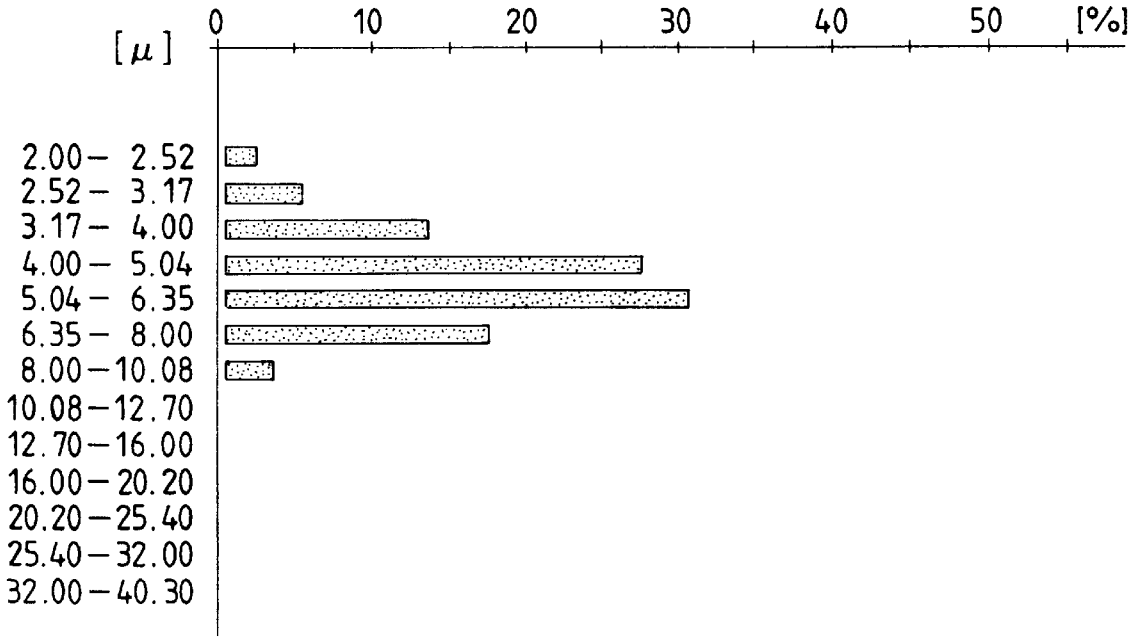
FIG. 7 shows a histogram of number-base distribution of a collected toner in Example 1.
Figure 8:
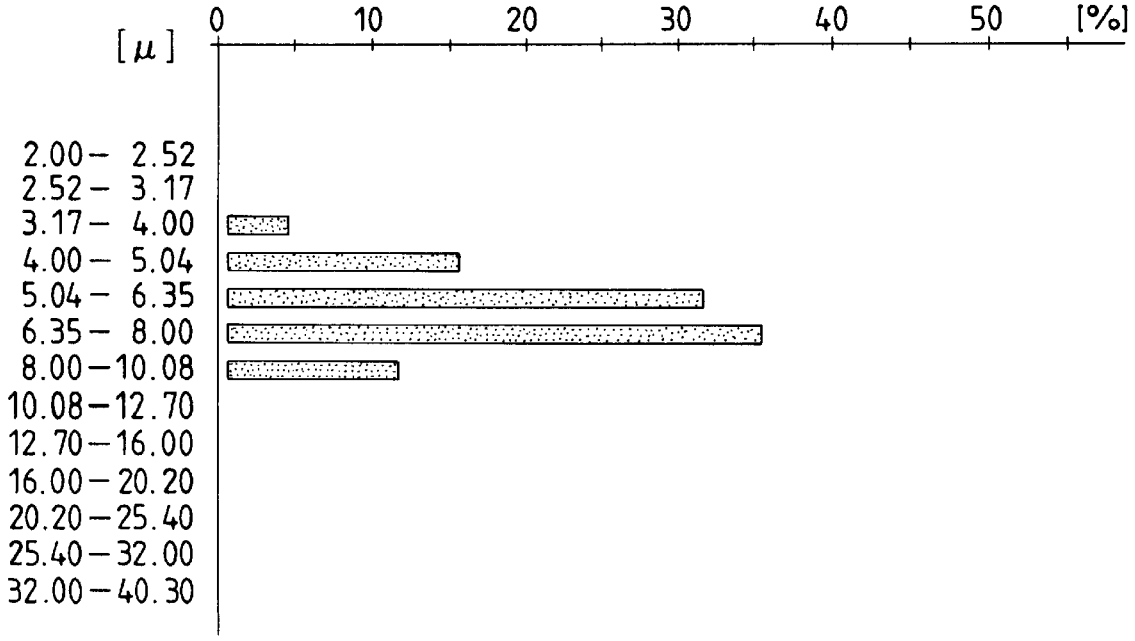
FIG. 8 shows a histogram of volume-base distribution of the collected toner.

Data of particle size distribution of the collected magnetic toner are shown in Table 2, a histogram of its number-base distribution is shown in FIG. 7, and a histogram of its volume-base distribution is shown in FIG. 8.

In the histogram of the number-base distribution in the recovered or collected magnetic toner (FIG. 7), a top peak was present in the range of particle diameters of from 5.04 to 6.35 μm, and a second peak was present in the range of particle diameters of from 4.00 to 5.04 μm.

In the histogram of the volume-base distribution in the recovered or collected magnetic toner (FIG. 8), a top peak was present in the range of particle diameters of from 6.35 to 8.00 μm, and a second peak was present in the range of particle diameters of from 5.04 to 6.35 μm.

TABLE 2

| | | Number-base(%) | | Volume-base(%) | |
|---|---|---|---|---|---|
| Size (μm) | Number | Distri-bution | Cumu-lative | Distri-bution | Cumu-lative |
| 2.00–2.52 | 4,392 | 2.9 | 2.9 | 0.0 | 0.0 |
| 2.52–3.17 | 7,539 | 5.1 | 8.0 | 0.7 | 0.7 |
| 3.17–4.00 | 20,263 | 13.6 | 21.6 | 4.0 | 4.7 |
| 4.00–5.04 | 40,839 | 27.4 | 49.0 | 15.4 | 20.1 |
| 5.04–6.35 | 44,912 | 30.1 | 79.1 | 31.8 | 51.9 |
| 6.35–8.00 | 26,342 | 17.7 | 96.8 | 35.7 | 87.6 |
| 8.00–10.08 | 4,629 | 3.1 | 99.9 | 11.5 | 99.1 |
| 10.08–12.70 | 137 | 0.1 | 100 | 0.6 | 99.7 |
| 12.70–16.00 | 16 | 0.0 | 100.0 | 0.0 | 99.7 |
| 16.00–20.20 | 14 | 0.0 | 100.0 | 0.3 | 100.0 |
| 20.20–25.40 | 5 | 0.0 | 100.0 | 0.0 | 100.0 |
| 25.40–32.00 | 1 | 0.0 | 100.0 | 0.0 | 100.0 |
| 32.00–40.30 | 0 | 0.0 | 100.0 | 0.0 | 100.0 |

As a result, even after image reproduction on 200,000 sheets, a high reflection image density was maintained, and neither fog nor toner scatter occurred, where the same high image quality as that at the start was maintained. After the image reproduction on 200,000 sheets, toner consumption was examined using an A4-size original prepared so as to have an image area percentage of 6%, to confirm that it was 0.032 g/sheet.

Results obtained are shown in Table 3 (3A–3C).

The multi-division classifier used in the present Example and a classification step using the classifier are described with reference to FIGS. 9 and 10. In FIGS. 9 and 10, side walls have the shapes as indicated by reference numerals 122 and 124 and a lower wall has the shape as indicated by reference numeral 125, where the side wall 123 and the lower wall 125 are provided with knife edge-shaped classifying wedges 126 and 127, respectively, and these classifying wedges 126 and 127 separate the classifying zone into three divisions. A material feed nozzle 128 opening into the classifying chamber is provided at the lower part of the side wall 122. A Coanda block 125 is disposed along an extension of the lower tangential line of the nozzle 128 so as to form a long elliptic arc that curves downward. The classifying chamber has an upper wall 130 provided with a knife edge-shaped air-intake wedge 131 extending downward, and further provided above the classifying chamber with air-intake pipes 132 and 133 opening into the classifying chamber. The air-intake pipes 132 and 133 are respectively provided with a first gas feed control means 134 and a second gas feed control means 135, respectively, comprising, e.g. a damper, and also provided with static pressure gauges 126 and 137. At the bottom of the classifying chamber, discharge pipes 111, 112 and 113 with outlets opening into the chamber are provided corresponding to the respective divisions. The powder to be classified is led under reduced pressure from the feed nozzle 128 into the classifying zone, and is moved by the Coanda effect, with a curve 141 by the action attributable to the Coanda effect of the Coanda block 129 and the action of the high-speed air concurrently flowing in, so that the powder is classified into black fine powder 134 and ultrafine powder 140, the former having given number average particle diameter, weight average particle diameter and particle size distribution.

Comparative Example 1

Example 1 was repeated to produce a magnetic toner in which the length average particle diameter ($D_1$) was 5.92 μm, the standard deviation of number-base distribution ($S_n$) was 2.49, the coefficient of variation of number-base distribution (A) was 42.0, the weight average particle diameter ($D_4$) was 8.93 μm, the standard deviation of volume-base distribution ($S_W$) was 2.70, and the coefficient of variation of volume-base distribution (B) was 30.2. This toner was used as the magnetic toner at the start of image reproduction and the supply magnetic toner.

In a histogram of the number-base distribution in the supply magnetic toner, a top peak (20.9% by number) was present in the range of particle diameters of from 6.35 to 8.00 μm, and a second peak (18.3% by number) was present in the range of particle diameters of from 5.04 to 6.35 μm.

In a histogram of the volume-base distribution in the supply magnetic toner, a top peak (26.5% by weight) was present in the range of particle diameters of from 8.00 to 10.08 μm, and a second peak (22.3% by weight) was present in the range of particle diameters of from 6.35 to 8.00 μm.

A 200,000 sheet image reproduction test was made in the same manner as in Example 1 while the recovered or collected magnetic toner was returned to the toner hopper and the supply magnetic toner was successively supplied.

Results obtained are shown in Table 3 (3A–3C).

In a histogram of the number-base distribution in the recovered or collected magnetic toner, a top peak (20.4% by number) was present in the range of particle diameters of from 2.52 to 3.17 μm, and a second peak (18.6% by number) was present in the range of particle diameters of from 2.00 to 2.52 μm.

In a histogram of the volume-base distribution in the recovered or collected magnetic toner, a top peak (18.2% by weight) was present in the range of particle diameters of from 8.00 to 10.08 μm, and a second peak (17.4% by weight) was present in the range of particle diameters of from 10.08 to 12.70 μm.

TABLE 3A

| Particle size distribution of supply magnetic toner | | | | | | |
|---|---|---|---|---|---|---|
| | $D_1$ (μm) | $S_n$ | A | $D_4$ (μm) | $S_w$ | B |
| Example: | | | | | | |
| 1 | 5.63 | 1.53 | 27.2 | 6.65 | 1.39 | 20.9 |
| Comparative Example: | | | | | | |
| 1 | 5.92 | 2.49 | 42.0 | 8.93 | 2.70 | 30.2 |

TABLE 3B

| Particle size distribution of collected magnetic toner | | | | | | |
|---|---|---|---|---|---|---|
| | $D_1$ (μm) | $S_n$ | A | $D_4$ (μm) | $S_w$ | B |
| Example: | | | | | | |
| 1 | 5.21 | 1.52 | 29.1 | 6.39 | 1.64 | 25.6 |

TABLE 3B-continued

| | Particle size distribution of collected magnetic toner | | | | | |
|---|---|---|---|---|---|---|
| | $D_1$ (μm) | $S_n$ | A | $D_4$ (μm) | $S_w$ | B |
| Comparative Example: | | | | | | |
| 1 | 4.52 | 2.12 | 46.9 | 9.51 | 3.45 | 36.3 |

TABLE 3C

| | Evaluation results at the start | | | | Evaluation results after running on 200,000 sheets | | | | Toner consumption |
|---|---|---|---|---|---|---|---|---|---|
| | Dmax | (1) | (2) | (3) | Dmax | (1) | (2) | (3) | (g/sheet) |
| Example: | | | | | | | | | |
| 1 | 1.48 | A | A | A | 1.51 | A | A | A | 0.032 |
| Comparative Example: | | | | | | | | | |
| 1 | 1.36 | A | A | A | 1.18 | BC | C | BC | 0.053 |

(1): Image quality, (2): Fog level, (3): Toner scatter
Evaluation:
A: Excellent
B: Passable
BC: A little problematic
C: Problematic

EXAMPLE 2

Example 1 was repeated to produce a magnetic toner having the particle size distribution as shown in Table 4, except that the negatively chargeable hydrophobic dry-process silica was mixed in an amount of 0.4 part. A 200,000 sheet image reproduction test was made in the same manner as in Example 1.

As a result, even after image reproduction on 200,000 sheets, a high reflection image density was maintained, and neither fog nor toner scatter occurred, where the same high image quality as that at the start was maintained. After the image reproduction on 200,000 sheets, toner consumption was examined using an A4-size original so prepared as to have an image area percentage of 6%, to confirm that it was 0.048 g/sheet.

Results obtained are shown in Table 7 (7A–7C).

TABLE 4

| | | Number-base(%) | | Volume-base(%) | |
|---|---|---|---|---|---|
| Size (μm) | Number | Distribution | Cumulative | Distribution | Cumulative |
| 2.00–2.52 | 714 | 0.9 | 0.9 | 0.0 | 0.0 |
| 2.52–3.17 | 1,007 | 1.3 | 2.2 | 0.0 | 0.0 |
| 3.17–4.00 | 2,456 | 3.1 | 5.3 | 0.0 | 0.0 |
| 4.00–5.04 | 8,685 | 11.0 | 16.3 | 2.6 | 2.6 |
| 5.04–6.35 | 18,218 | 23.0 | 39.3 | 10.4 | 13.0 |
| 6.35–8.00 | 19,798 | 25.0 | 64.3 | 20.4 | 33.4 |
| 8.00–10.08 | 17,470 | 22.1 | 86.4 | 29.1 | 62.5 |
| 10.08–12.70 | 9,367 | 11.8 | 98.2 | 29.2 | 91.7 |
| 12.70–16.00 | 1,376 | 1.7 | 100.0 | 8.3 | 100.0 |
| 16.00–20.20 | 31 | 0.0 | 100.0 | 0.0 | 100.0 |
| 20.20–25.40 | 5 | 0.0 | 100.0 | 0.0 | 100.0 |

TABLE 4-continued

| | | Number-base(%) | | Volume-base(%) | |
|---|---|---|---|---|---|
| Size (μm) | Number | Distribution | Cumulative | Distribution | Cumulative |
| 25.40–32.00 | 1 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

EXAMPLE 3

Styrene/2-ethylhexyl acrylate/monobutyl maleate/divinylbenzene copolymer (copolymerization weight ratio: 69:24:6:1) 100 parts Magnetic iron oxide (average particle diameter: 0.2 μm) 100 parts Chromium complex of an azo dye (number average particle diameter: 2.5 μm) 1 part Low-molecular-weight polypropylene 3 parts The above materials were treated in the same manner as in Example 2 to give a black fine powder (a magnetic toner) with a weight average particle diameter ($D_4$) of 8.33 μm.

To 100 parts of the black fine powder thus obtained, 0.6 part of negatively chargeable hydrophobic dry-process silica (BET specific surface area: 240 $m^2/g$) was added, followed by mixing using a Henschel mixer to give a one-component magnetic toner.

Data of its particle size distribution are shown in Table 5. The length average particle diameter on the basis of number ($D_1$) was 6.67 μm, the standard deviation of number-base distribution ($S_n$) was 2.19, the coefficient of variation of number-base distribution (A) was 32.8, the standard deviation of volume-base distribution ($S_W$) was 2.21, and the coefficient of variation of volume-base distribution (B) was 26.5.

A 200,000 sheet image reproduction was carried out in the same manner as in Example 2. As a result, all the image density, fog and toner scatter were at levels of no problem.

Detailed results of evaluation are as shown in Table 7 (7A–7C).

TABLE 5

| | | Number-base(%) | | Volume-base(%) | |
|---|---|---|---|---|---|
| Size (μm) | Number | Distribution | Cumulative | Distribution | Cumulative |
| 2.00–2.52 | 894 | 1.4 | 1.4 | 0.0 | 0.0 |
| 2.52–3.17 | 1,810 | 2.9 | 4.3 | 0.0 | 0.0 |
| 3.17–4.00 | 3,668 | 5.9 | 10.2 | 0.9 | 0.9 |
| 4.00–5.04 | 8,862 | 14.2 | 24.3 | 4.6 | 5.5 |
| 5.04–6.35 | 14,768 | 23.6 | 47.9 | 13.8 | 19.3 |
| 6.35–8.00 | 16,931 | 27.0 | 75.0 | 28.7 | 47.9 |
| 8.00–10.08 | 11,858 | 18.9 | 93.9 | 32.1 | 80.0 |
| 10.08–12.70 | 3,564 | 5.7 | 99.6 | 17.6 | 97.7 |
| 12.70–16.00 | 236 | 0.4 | 100.0 | 2.3 | 100.0 |
| 16.00–20.20 | 7 | 0.0 | 100.0 | 0.0 | 100.0 |
| 20.20–25.40 | 0 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

EXAMPLE 4

Cross-linked polyester resin (weight average molecular weight: 50,000; Tg: 60° C.) 100 parts Chromium complex of 3,5-di-tert-butylsalicylic acid (number average particle diameter: 2.8 μm) 2 parts Triiron tetraoxide (average particle diameter: 0.2 μm) 90 parts Low-molecular-weight propylene-ethylene copolymer 3 parts Using the above materials, a black fine powder was obtained in the same manner as in Example 2. To 100 parts of the black fine powder (a magnetic toner) thus obtained, 0.8 part of negatively chargeable hydrophobic dry-process silica (BET specific surface area: 300 $m^2/g$) was added, followed by mixing using a Henschel mixer to give a negatively chargeable one-component magnetic toner. Using this magnetic toner, image evaluation was made in the same manner as in Example 2. Results obtained were good as shown in Table 7 (7A–7C).

EXAMPLE 5

A magnetic toner was prepared in the same manner as in Example 2 except that the chromium complex of 3,5-di-tert-butylsalicylic acid used therein was replaced with 2 parts of a positive charge control agent Nigrosine (number average particle diameter: about 3 μm). To 100 parts of the magnetic toner thus obtained, 1.0 part of positively chargeable hydrophobic dry-process silica (BET specific surface area: 200 $m^2/g$) was added, followed by mixing using a Henschel mixer to give a positively chargeable one-component magnetic toner.

Then, using a modified machine of a copying machine NP4835 (equipped with an OPC photosensitive drum), manufactured by Canon Inc., which was so modified to have the recycle system as shown in FIG. 3, a continuous 200,000 sheet image reproduction was carried out to make evaluation. Images were reproduced at a copying speed of 35 sheets per minute on A4-size paper. As a result, always stable and good images were obtained as shown in Table 7 (7A–7C).

EXAMPLE 6

Image evaluation was made in the same manner as in Example 2 except that, in the copying machine used to make evaluation in Example 2, the connecting position of the pipe was so changed that the untransferred toner (the toner scraped off by a cleaning means) was directly introduced into the developing assembly. As a result, as shown in Table 7 (7A–7C), good results were obtainable without great differences from those in Example 2.

Comparative Example 2

Evaluation was made in the same manner as in Example 2 except that the toner used therein was replaced with a toner so prepared to have the particle size distribution as shown in Table 6, by controlling conditions for fine pulverization and classification. As a result, as shown in Table 7 (7A–7C), a decrease in reflection image density, a lowering of image quality and an increase in fog and toner scatter were seen as recycling was continued.

TABLE 6

| | | Number-base(%) | | Volume-base(%) | |
|---|---|---|---|---|---|
| Size (μm) | Number | Distri-bution | Cumu-lative | Distri-bution | Cumu-lative |
| 2.00–2.52 | 2,439 | 2.8 | 2.8 | 0.0 | 0.0 |
| 2.52–3.17 | 2,763 | 3.2 | 6.0 | 0.0 | 0.0 |

TABLE 6-continued

| | | Number-base(%) | | Volume-base(%) | |
|---|---|---|---|---|---|
| Size (μm) | Number | Distri-bution | Cumu-lative | Distri-bution | Cumu-lative |
| 3.17–4.00 | 5,513 | 6.3 | 12.3 | 1.0 | 1.0 |
| 4.00–5.04 | 14,767 | 16.9 | 29.2 | 5.7 | 6.7 |
| 5.04–6.35 | 24,348 | 27.9 | 57.1 | 17.7 | 24.4 |
| 6.35–8.00 | 20,869 | 23.9 | 81.0 | 27.5 | 51.9 |
| 8.00–10.08 | 11,609 | 13.3 | 94.3 | 25.0 | 76.9 |
| 10.08–12.70 | 4,325 | 5.0 | 99.3 | 17.9 | 94.8 |
| 12.70–16.00 | 573 | 0.7 | 99.9 | 4.7 | 99.5 |
| 16.00–20.20 | 38 | 0.0 | 100.0 | 0.5 | 100.0 |
| 20.20–25.40 | 7 | 0.0 | 100.0 | 0.0 | 100.0 |
| 25.40–32.00 | 1 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Comparative Example 3

Evaluation was made in the same manner as in Example 3 except that the toner used therein was replaced with a toner prepared so as to have the particle size distribution as shown in Table 7, by controlling conditions for fine pulverization and classification.

Results obtained are shown in Table 7 (7A–7C).

Comparative Example 4

Evaluation was made in the same manner as in Example 4 except that the toner used therein was replaced with a toner prepared so as to have the particle size distribution as shown in Table 7, by controlling conditions for fine pulverization and classification. Results obtained are shown in Table 7 (7A–7C).

Comparative Example 5

Evaluation was made in the same manner as in Example 5 except that the toner used therein was replaced with a toner prepared so as to have the particle size distribution as shown in Table 7, by controlling conditions for fine pulverization and classification. As a result, as shown in Table 7 (7A–7C), the levels of all the image density, image quality, fog and toner scatter were seen to become lower as the recycled toner was reused.

Comparative Example 6

Evaluation was made in the same manner as in Example 2 except that the untransferred toner used therein (the toner scraped off by a cleaning means) was not reused. As a result, as shown in Table 7 (7A–7C), although there was no problems at all in regard to the image quality after copying on 200,000 sheets, toner consumption was 0.063 g/sheet, and was seen to have increased by as much as 19% compared with the case of Example 2.

TABLE 7A

| Particle size distribution of supply magnetic toner | | | | | | |
|---|---|---|---|---|---|---|
| | $D_1$ (μm) | $S_n$ | A | $D_4$ (μm) | $S_w$ | B |
| Example: | | | | | | |
| 2 | 7.37 | 2.44 | 33.0 | 9.32 | 2.50 | 26.9 |
| 3 | 6.67 | 2.19 | 32.8 | 8.33 | 2.21 | 26.5 |

TABLE 7A-continued

| Particle size distribution of supply magnetic toner | | | | | | |
|---|---|---|---|---|---|---|
| | $D_1$ (μm) | $S_n$ | A | $D_4$ (μm) | $S_w$ | B |
| 4 | 7.02 | 2.39 | 34.1 | 8.80 | 2.44 | 27.8 |
| 5 | 6.87 | 2.52 | 36.6 | 9.04 | 2.50 | 27.7 |
| 6 | 7.37 | 2.44 | 33.0 | 9.32 | 2.50 | 26.9 |
| Comparative Example: | | | | | | |
| 2 | 6.32 | 2.56 | 40.5 | 8.34 | 2.57 | 30.9 |
| 3 | 5.24 | 2.20 | 42.0 | 6.02 | 1.76 | 29.2 |
| 4 | 10.38 | 3.54 | 34.1 | 13.20 | 3.67 | 27.8 |
| 5 | 6.55 | 2.85 | 43.5 | 9.81 | 3.41 | 34.7 |
| 6 | 7.37 | 2.44 | 33.0 | 9.32 | 2.50 | 26.9 |

TABLE 7B

| Particle size distribution of collected magnetic toner | | | | | | |
|---|---|---|---|---|---|---|
| | $D_1$ (μm) | $S_n$ | A | $D_4$ (μm) | $S_w$ | B |
| Example: | | | | | | |
| 2 | 7.14 | 2.69 | 37.7 | 9.86 | 3.20 | 32.5 |
| 3 | 6.58 | 2.34 | 35.6 | 8.01 | 2.47 | 30.8 |
| 4 | 7.25 | 2.88 | 39.7 | 8.49 | 2.90 | 34.2 |
| 5 | 6.53 | 2.57 | 39.3 | 8.95 | 2.83 | 31.6 |
| 6 | 7.54 | 2.92 | 38.8 | 9.21 | 3.05 | 33.1 |
| Comparative Example: | | | | | | |
| 2 | 6.61 | 3.06 | 46.3 | 8.22 | 3.03 | 36.9 |
| 3 | 4.73 | 2.28 | 48.3 | 7.54 | 2.66 | 35.3 |
| 4 | 10.52 | 4.04 | 38.4 | 14.31 | 5.21 | 36.4 |
| 5 | 4.97 | 2.40 | 48.3 | 8.03 | 3.27 | 40.7 |
| 6 | — | — | — | — | — | — |

TABLE 7C

| | Evaluation results at the start | | | | Evaluation results after running on 200,000 sheets | | | | Toner consumption |
|---|---|---|---|---|---|---|---|---|---|
| | Dmax | (1) | (2) | (3) | Dmax | (1) | (2) | (3) | (g/sheet) |
| Example: | | | | | | | | | |
| 2 | 1.40 | A | A | A | 1.42 | A | A | A | 0.048 |
| 3 | 1.43 | A | A | A | 1.41 | A | A | A | 0.045 |
| 4 | 1.45 | A | A | A | 1.40 | A | A | A | 0.050 |
| 5 | 1.35 | A | A | A | 1.35 | A | A | A | 0.055 |
| 6 | 1.40 | A | A | A | 1.41 | A | A | A | 0.047 *1 |
| Comparative Example: | | | | | | | | | |
| 2 | 1.38 | A | A | A | 1.25 | BC | B | B | 0.051 |
| 3 | 1.37 | A | A | A | 1.20 | BC | BC | B | 0.050 |
| 4 | 1.32 | A | A | A | 1.20 | B | B | B | 0.040 |
| 5 | 1.30 | A | A | A | 1.10 | C | C | C | 0.053 |
| 6 | 1.40 | A | A | A | 1.42 | A | A | A | 0.063 *2 |

(1): Image quality, (2): Fog level, (3): Toner scatter
A, B, BC, C: The same as in Table 1
Remarks:
*1 The collected toner was returned to the developing assembly.
*2 The collected toner was not recycled.

EXAMPLE 7

Styrene/butyl acrylate/butyl maleate/divinylbenzene copolymer (copolymerization weight ratio: 73.5:19:7:0.5; weight average molecular weight: 320,000) 100 parts Carbon black 4 parts Chromium complex of 3,5-di-tert-butylsalicylic acid (number average particle diameter: 2.8 μm) 2 parts Low-molecular-weight polypropylene 3 parts The above materials were thoroughly premixed using a blender mixer, and then kneaded using a twin-screw kneading extruder set to 150° C. The resulting kneaded product was cooled, and then crushed using a cutter mill to a size of 1 mm or less. Thereafter, the crushed product was finely pulverized using a fine grinding mill utilizing a jet stream. The resulting finely pulverized product was classified using a fixed wall type air classifier to produce a classified powder. The resulting classified powder was further put in a multi-division classifier utilizing the Coanda effect (Elbow Jet Classifier, manufactured by Nittetsu Kogyo Co.) to strictly classify and remove ultrafine powder and coarse powder. Thus, a black fine powder (a non-magnetic toner) with a weight average particle diameter ($D_4$) of 8.04 μm was obtained.

To 100 parts of the toner thus obtained, 0.8 part of negatively chargeable hydrophobic dry-process silica (BET specific surface area: 240 $m^2/g$) was added, followed by mixing using a Henschel mixer. Then, 10 parts of this toner (having silica on the particle surfaces) and 90 parts of ferrite carrier (volume average particle diameter: 35 μm) coated with 0.5% by weight of a 1:1 mixed resin comprised of a vinylidene fluoride/tetrafluoroethylene copolymer (polymerization weight ratio of monomers: 80/20) and a styrene/2-ethylhexyl acrylate/methyl methacrylate copolymer (polymerization weight ratio of monomers: 45/20/35) were blended to give a two-component developer.

The particle size distribution of this non-magnetic toner was measured using the Coulter counter Type TA-II having an aperture of 100 μm as previously described, to obtain the data shown in Table 8 below. Here, the length average particle diameter on the basis of number ($D_1$) was 6.53 82 m, the standard deviation of number-base distribution ($S_n$) was 2.06, the coefficient of variation of number-base distribution (A) was 31.6, the standard deviation of volume-base distribution ($S_W$) was 2.06, and the coefficient of variation of volume-base distribution (B) was 25.6.

TABLE 8

| | | Number-base(%) | | Volume-base(%) | |
|---|---|---|---|---|---|
| Size (μm) | Number | Distribution | Cumulative | Distribution | Cumulative |
| 2.00–2.52 | 1,575 | 1.5 | 1.5 | 0.0 | 0.0 |
| 2.52–3.17 | 2,920 | 2.8 | 4.3 | 0.0 | 0.0 |
| 3.17–4.00 | 6,018 | 5.8 | 10.1 | 0.9 | 0.9 |
| 4.00–5.04 | 14,872 | 14.3 | 24.4 | 4.9 | 5.8 |
| 5.04–6.35 | 26,528 | 25.5 | 49.9 | 15.8 | 21.6 |
| 6.35–8.00 | 29,188 | 28.1 | 78.0 | 31.7 | 53.3 |
| 8.00–10.08 | 18,326 | 17.6 | 95.6 | 31.9 | 85.2 |
| 10.08–12.70 | 4,313 | 4.1 | 99.8 | 13.5 | 98.7 |
| 12.70–16.00 | 210 | 0.2 | 100.0 | 1.3 | 100.0 |
| 16.00–20.20 | 7 | 0.0 | 100.0 | 0.0 | 100.0 |
| 20.20–25.40 | 3 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

The two-component non-magnetic developer thus prepared was introduced into a modified machine of a copying machine NP5060 (equipped with an amorphous silicon drum), manufactured by Canon Inc., which, as shown in FIG. 2, was so modified for the untransferred toner (the toner scraped off by a cleaning means) to be returned to a supply toner hopper through a pipe provided in its inside with a delivery screw, to be lightly agitated together with the supply toner held in the hopper and thereafter to be supplied to the developing assembly thereof, like the modified machine shown in FIG. 3, and employed as a developing assembly the one shown in FIG. 2. A continuous 100,000 sheet image reproduction test was made.

As a result, even after image reproduction on 100,000 sheets, a high reflection image density was maintained, and neither fog nor toner scatter occurred, where the same high image quality as that at the start was maintained. After the image reproduction on 100,000 sheets, toner consumption was examined using an A4-size original prepared so as to have an image area percentage of 6%, to confirm that it was 0.045 g/sheet.

Results obtained are shown in Table 10 (10A–10C).

Development conditions are described below with reference to FIG. 2.

A latent image bearing member 1 (a photosensitive drum) was rotated in the direction of an arrow a. Reference numeral 4 denotes a developing sleeve made of stainless steel, which was rotated in the direction of an arrow b. Its surface had been blasted using spherical glass beads.

Meanwhile, a ferrite sinter type magnet 5 was set stationarily inside the rotating developing sleeve 3, and polarities thereof were arranged as shown in FIG. 2. A non-magnetic blade 25 used was 1.2 mm thick and made of non-magnetic stainless steel. The gap between the blade and the sleeve was set to be 400 μm.

A closest distance between the developing sleeve 4 and the latent image bearing member 1 was set to be 250 μm. To the sleeve 4, a bias with a frequency of 1,800 Hz and a peak-to-peak value of 1,400 V was applied through a bias power source to carry out development.

EXAMPLE 8

Styrene/2-ethylhexyl acrylate/monobutyl maleate/divinylbenzene copolymer (copolymerization weight ratio: 69:24:6:1) 100 parts Permanent Red 4 parts Chromium complex of an azo dye (number average particle diameter: 2.5 μm) 1 part Low-molecular-weight polypropylene 3 parts The above materials were treated in the same manner as in Example 7 to give a red fine powder (a non-magnetic toner) with a weight average particle diameter (D4) of 7.81 μm.

To 100 parts of the red fine powder thus obtained, 1.2 parts of negatively chargeable hydrophobic dry-process silica (BET specific surface area: 240 $m^2/g$) was added, followed by mixing using a Henschel mixer to give a developer.

Data of its particle size distribution are shown in Table 9. The length average particle diameter on the basis of number ($D_1$) was 6.33 μm, the standard deviation of number-base distribution ($S_n$) was 2.09, the coefficient of variation of number-base distribution (A) was 32.9, the standard deviation of volume-base distribution ($S_W$) was 1.93, and the coefficient of variation of volume-base distribution (B) was 24.7.

A 100,000 sheet image reproduction was carried out in the same manner as in Example 7. As a result, all the image density, fog and toner scatter were at levels of no problem.

Detailed results of evaluation are as shown in Table 11 (11A–11C).

TABLE 9

| | | Number-base(%) | | Volume-base(%) | |
|---|---|---|---|---|---|
| Size (μm) | Number | Distribution | Cumulative | Distribution | Cumulative |
| 2.00–2.52 | 1,650 | 2.0 | 2.0 | 0.0 | 0.0 |
| 2.52–3.17 | 3,375 | 4.1 | 6.0 | 0.3 | 0.3 |
| 3.17–4.00 | 6,312 | 7.6 | 13.6 | 1.4 | 1.7 |
| 4.00–5.04 | 13,179 | 15.9 | 29.5 | 5.9 | 7.6 |
| 5.04–6.35 | 19,524 | 23.5 | 53.0 | 15.9 | 23.5 |
| 6.35–8.00 | 21,263 | 25.6 | 78.6 | 31.3 | 54.8 |
| 8.00–10.08 | 15,213 | 18.3 | 96.9 | 35.1 | 89.9 |
| 10.08–12.70 | 2,512 | 3.0 | 99.9 | 9.8 | 99.7 |
| 12.70–16.00 | 52 | 0.1 | 100.0 | 0.3 | 100.0 |
| 16.00–20.20 | 2 | 0.0 | 100.0 | 0.0 | 100.0 |
| 20.20–25.40 | 0 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

EXAMPLE 9

Cross-linked polyester resin (weight average molecular weight: 50,000; Tg: 60° C.) 100 parts Copper phthalocyanine 4 parts Chromium complex of 3,5-di-tert-butylsalicylic acid 2 parts Low-molecular-weight propylene-ethylene copolymer 3 parts Using the above materials, a blue fine powder was obtained in the same manner as in Example 7. To 100 parts of the blue fine powder (a non-magnetic toner) thus obtained, 0.8 part of negatively chargeable hydrophobic dry-process silica (BET specific surface area: 300 $m^2/g$) was added, followed by mixing using a Henschel mixer to give a negatively chargeable non-magnetic developer. Using this developer, image evaluation was made in the same manner as in Example 7. Results obtained were good as shown in Table 11 (11A–11C).

EXAMPLE 10

A non-magnetic toner was prepared in the same manner as in Example 7 except that the chromium complex of 3,5-di-tert-butylsalicylic acid used therein was replaced with 2 parts of Nigrosine (number average particle diameter: about 3 μm) and ferrite carrier (volume average particle diameter: 50 μm) coated with 1.2% by weight of a 1:1 mixed resin comprised of a vinylidene fluoride/tetrafluoroethylene copolymer (polymerization weight ratio of monomers: 75/25) and a styrene/methyl methacrylate copolymer (polymerization weight ratio of monomers: 70/30) was used as the carrier. To 100 parts of the non-magnetic toner thus obtained, 1.0 part of positively chargeable hydrophobic dry-process silica (BET specific surface area: 200 $m^2/g$) was added, followed by mixing using a Henschel mixer to give a positively chargeable two-component developer having the non-magnetic toner.

Then, using a modified machine of a copying machine NP4835 (equipped with an OPC photosensitive drum), manufactured by Canon Inc., which was modified as shown in FIG. 2, a continuous 100,000 sheet image reproduction was carried out to make evaluation. As a result, always stable and good images were obtained as shown in Table 11 (11A–11C).

EXAMPLE 11

Image evaluation was made in the same manner as in Example 7 except that, in the copying machine used to make evaluation in Example 7, the connecting position of the pipe was so changed that the untransferred toner (the toner scraped off by a cleaning means) was directly introduced into the developing assembly. As a result, as shown in Table 11 (11A–11C), good results were obtainable without great differences from those in Example 7.

Comparative Example 7

Evaluation was made in the same manner as in Example 7 except that the toner used therein was replaced with a toner prepared so as to have the particle size distribution as shown in Table 10, by controlling conditions for fine pulverization and classification. As a result, as shown in Table 11 (11A–11C), a decrease in reflection image density, a lowering of image quality and an increase in fog and toner scatter were seen as recycling was continued.

TABLE 10

| | | Number-base(%) | | Volume-base(%) | |
|---|---|---|---|---|---|
| Size (μm) | Number | Distribution | Cumulative | Distribution | Cumulative |
| 2.00–2.52 | 1,260 | 2.4 | 2.4 | 0.0 | 0.0 |
| 2.52–3.17 | 1,749 | 3.3 | 5.7 | 0.0 | 0.0 |
| 3.17–4.00 | 3,933 | 7.4 | 13.1 | 0.9 | 0.9 |
| 4.00–5.04 | 9,201 | 17.3 | 30.4 | 4.6 | 5.5 |
| 5.04–6.35 | 11,265 | 21.2 | 51.5 | 10.8 | 16.4 |
| 6.35–8.00 | 10,669 | 20.1 | 71.6 | 19.1 | 35.5 |
| 8.00–10.08 | 9,360 | 17.6 | 89.2 | 27.6 | 63.1 |
| 10.08–12.70 | 4,945 | 9.3 | 98.5 | 27.2 | 90.3 |
| 12.70–16.00 | 700 | 1.3 | 99.8 | 7.8 | 98.1 |
| 16.00–20.20 | 93 | 0.2 | 100.0 | 1.9 | 100.0 |
| 20.20–25.40 | 8 | 0.0 | 100.0 | 0.0 | 100.0 |
| 25.40–32.00 | 5 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Comparative Example 8

Evaluation was made in the same manner as in Example 8 except that the toner used therein was replaced with a toner prepared so as to have the particle size distribution as shown in Table 11, by controlling conditions for fine pulverization and classification.

Results obtained are shown in Table 11 (11A–11C).

Comparative Example 9

Evaluation was made in the same manner as in Example 9 except that the toner used therein was replaced with a toner prepared so as to have the particle size distribution as shown in Table 11, by controlling conditions for fine pulverization and classification.

Results obtained are shown in Table 11 (11A–11C).

Comparative Example 10

Evaluation was made in the same manner as in Example 10 except that the toner used therein was replaced with a toner prepared so as to have the particle size distribution as shown in Table 11, by controlling conditions for fine pulverization and classification. As a result, as shown in Table 11 (11A–11C), the levels of all the image density, image quality, fog and toner scatter were seen to become lower as the recycled toner was reused.

Comparative Example 11

Evaluation was made in the same manner as in Example 7 except that the untransferred toner used therein (the toner scraped off by a cleaning means) was not reused. As a result, as shown in Table 11 (11A–11C), although there was no problems at all in regard to the image quality after copying on 100,000 sheets, toner consumption was 0.055 g/sheet, and was seen to have increased by as much as 22% compared with the case of Example 7.

TABLE 11A

Particle size distribution of supply nonmagnetic toner

| | $D_1$ (μm) | $S_n$ | A | $D_4$ (μm) | $S_w$ | B |
|---|---|---|---|---|---|---|
| Example: | | | | | | |
| 7 | 6.53 | 2.06 | 31.6 | 8.04 | 2.06 | 25.6 |
| 8 | 6.33 | 2.09 | 32.9 | 7.81 | 1.93 | 24.7 |
| 9 | 7.26 | 2.48 | 34.1 | 9.31 | 2.58 | 27.7 |
| 10 | 7.75 | 2.29 | 29.6 | 9.28 | 2.24 | 24.1 |
| 11 | 6.53 | 2.06 | 31.6 | 8.04 | 2.06 | 25.6 |
| Comparative Example: | | | | | | |
| 7 | 6.72 | 2.84 | 42.3 | 9.29 | 2.88 | 31.0 |
| 8 | 6.23 | 2.56 | 41.1 | 7.82 | 2.26 | 28.9 |
| 9 | 8.74 | 2.59 | 29.6 | 11.62 | 2.80 | 24.1 |
| 10 | 6.97 | 2.84 | 40.8 | 9.60 | 3.06 | 31.9 |
| 11 | 6.53 | 2.06 | 31.6 | 8.04 | 20.6 | 25.6 |

TABLE 11B

Particle size distribn of collected nonmagnetic toner

| | $D_1$ (μm) | $S_n$ | A | $D_4$ (μm) | $S_w$ | B |
|---|---|---|---|---|---|---|
| Example: | | | | | | |
| 7 | 6.43 | 2.37 | 36.9 | 8.15 | 2.64 | 32.4 |
| 8 | 6.27 | 2.41 | 38.4 | 7.55 | 1.99 | 26.3 |
| 9 | 7.07 | 2.86 | 40.5 | 9.43 | 3.22 | 34.1 |
| 10 | 7.54 | 2.37 | 31.4 | 8.98 | 2.37 | 26.4 |
| 11 | 6.44 | 2.80 | 35.4 | 8.11 | 2.41 | 29.7 |
| Comparative Example: | | | | | | |
| 7 | 5.87 | 2.73 | 46.5 | 11.43 | 4.21 | 36.8 |
| 8 | 5.56 | 2.70 | 48.5 | 7.75 | 2.67 | 34.5 |
| 9 | 9.54 | 3.70 | 38.8 | 13.45 | 3.95 | 29.4 |
| 10 | 6.54 | 3.03 | 46.3 | 10.45 | 3.92 | 37.5 |
| 11 | — | — | — | — | — | — |

TABLE 11C

| | Evaluation results at the start | | | | Evaluation results after running on 100,000 sheets | | | | Toner consumption |
|---|---|---|---|---|---|---|---|---|---|
| | Dmax | (1) | (2) | (3) | Dmax | (1) | (2) | (3) | (g/sheet) |
| Example: | | | | | | | | | |
| 7 | 1.37 | A | A | A | 1.39 | A | A | A | 0.045 |
| 8 | 1.25 | A | A | A | 1.24 | A | A | A | 0.043 |
| 9 | 1.27 | A | A | A | 1.25 | A | A | A | 0.040 |
| 10 | 1.33 | A | A | A | 1.35 | A | A | A | 0.050 |
| 11 | 1.37 | A | A | A | 1.35 | A | A | A | 0.044 *1 |
| Comparative Example: | | | | | | | | | |
| 7 | 1.26 | A | A | A | 1.14 | BC | B | B | 0.048 |
| 8 | 1.23 | A | A | A | 1.10 | BC | C | BC | 0.050 |
| 9 | 1.25 | A | A | A | 1.15 | B | B | B | 0.042 |

TABLE 11C-continued

| | Evaluation results at the start | | | | Evaluation results after running on 100,000 sheets | | | | Toner consumption |
|---|---|---|---|---|---|---|---|---|---|
| | Dmax | (1) | (2) | (3) | Dmax | (1) | (2) | (3) | (g/sheet) |
| 10 | 1.15 | AB | B | A | 0.70 | C | C | C | 0.052 |
| 11 | 1.37 | A | A | A | 1.36 | A | A | A | 0.059 *2 |

(1): Image quality, (2): Fog level, (3): Toner scatter
A, B, BC, C: The same as in Table 1; AB: Good
Remarks:
*1 The collected toner was returned to the developing assembly.
*2 The collected toner was not recycled.

EXAMPLE 12

Styrene/butyl acrylate/butyl maleate/divinylbenzene copolymer (copolymerization weight ratio: 73.5:19:7:0.5; weight average molecular weight: 320,000) 100 parts Copper phthalocyanine 4 parts Chromium complex of 3,5-di-tert-butylsalicylic acid (number average particle diameter: 2.8 μm) 2 parts Low-molecular-weight polypropylene 3 parts The above materials were thoroughly premixed using a blender mixer, and then kneaded using a twin-screw kneading extruder set to 150° C. The resulting kneaded product was cooled, and then crushed using a cutter mill to a size of 1 mm or less. Thereafter, the crushed product was finely pulverized using a fine grinding mill utilizing a jet stream. The resulting finely pulverized product was classified using a fixed wall type air classifier to produce a classified powder. The resulting classified powder was further put in a multi-division classifier utilizing the Coanda effect (Elbow Jet Classifier, manufactured by Nittetsu Kogyo Co.) to strictly classify and remove ultrafine powder and coarse powder. Thus, a blue fine powder (a non-magnetic toner) with a weight average particle diameter ($D_4$) of 8.30 μm was obtained.

To 100 parts of the blue fine powder non-magnetic toner thus obtained, 1.0 part of negatively chargeable hydrophobic dry-process silica (BET specific surface area: 240 $m^2/g$) was added, followed by mixing using a Henschel mixer to give a negatively chargeable one-component non-magnetic toner.

The particle size distribution of this non-magnetic toner was measured using the Coulter counter Type TA-II having an aperture of 100 μm as previously described, to obtain the data shown in Table 12 below. Here, the length average particle diameter on the basis of number ($D_1$) was 6.42 μm, the standard deviation of number-base distribution ($S_n$) was 2.25, the coefficient of variation of number-base distribution (A) was 35.0, the standard deviation of volume-base distribution ($S_W$) was 2.35, and the coefficient of variation of volume-base distribution (B) was 28.3.

TABLE 12

| | | Number-base(%) | | Volume-base(%) | |
|---|---|---|---|---|---|
| Size (μm) | Number | Distribution | Cumulative | Distribution | Cumulative |
| 2.00–2.52 | 1,451 | 1.1 | 1.1 | 0.0 | 0.0 |
| 2.52–3.17 | 3,803 | 2.9 | 4.0 | 0.0 | 0.0 |
| 3.17–4.00 | 10,415 | 8.0 | 12.0 | 1.2 | 1.2 |
| 4.00–5.04 | 25,187 | 19.2 | 31.2 | 6.6 | 7.9 |

TABLE 12-continued

| | | Number-base(%) | | Volume-base(%) | |
|---|---|---|---|---|---|
| Size (μm) | Number | Distribution | Cumulative | Distribution | Cumulative |
| 5.04–6.35 | 32,008 | 24.5 | 55.7 | 15.3 | 23.1 |
| 6.35–8.00 | 28,272 | 21.6 | 77.3 | 24.4 | 47.5 |
| 8.00–10.08 | 21,319 | 16.3 | 93.6 | 30.0 | 77.5 |
| 10.08–12.70 | 7,919 | 6.1 | 99.6 | 20.2 | 97.7 |
| 12.70–16.00 | 478 | 0.4 | 100.0 | 2.3 | 100.0 |
| 16.00–20.20 | 18 | 0.0 | 100.0 | 0.0 | 100.0 |
| 20.20–25.40 | 4 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Figure 4:
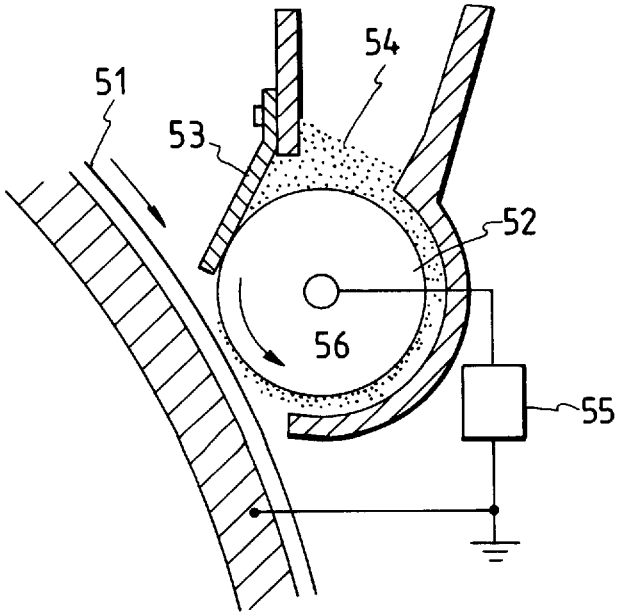
FIG. 4 is a schematic illustration of a developing assembly employing a non-magnetic one-component toner.

The one-component non-magnetic toner thus prepared was introduced into a modified machine of a copying machine NP5060, manufactured by Canon Inc., which, as shown in FIG. 3, was modified so that the untransferred toner (the toner scraped off by a cleaning means) was returned to a supply toner hopper through a pipe provided in its inside with a delivery screw, to be lightly agitated together with the supply toner held in the hopper and thereafter to be supplied to the developing assembly thereof, and, with regard to the developing assembly, was modified as shown in the accompanying drawing FIG. 4. A continuous 100,000 sheet image reproduction test was made.

As a result, even after image reproduction on 100,000 sheets, a high reflection image density was maintained, and neither fog nor toner scatter occurred, where the same high image quality as that at the start was maintained. After the image reproduction on 100,000 sheets, toner consumption was examined using an A4-size original prepared so as to have an image area percentage of 6%, to confirm that it was 0.045 g/sheet.

Results obtained are shown in Table 15 (15A–15C).

Development conditions are described below with reference to FIG. 4.

The non-magnetic one-component toner, 54, was coated in a thin layer by means of a coating member 53 on the surface of a cylindrical sleeve 52 made of stainless steel, rotated in the direction of an arrow 57. The closest distance between a photosensitive drum (the latent image bearing member) 51 provided with an organic photoconductive layer having a negatively charged toner image, rotated in the direction of an arrow 55, and a sleeve 52 was set to be about 250 μm. A bias of 2,000 Hz and 1,400 Vpp overlapping an AC bias and a DC bias was applied across the photosensitive drum 51 and the sleeve 52 through a bias power source 55. Charges of the one-component developer layer per unit area on the sleeve 52 were in a quantity of $-7.0\times10^{-9}$ μc/$cm^2$, the coating thereof per unit area was in a quantity of 0.60 mg/$cm^2$, and the toner layer was in thickness of 25 μm.

EXAMPLE 13

Styrene/2-ethylhexyl acrylate/monobutyl maleate/divinylbenzene copolymer (copolymerization weight ratio: 69:24:6:1) 100 parts Permanent Red 4 parts Chromium complex of an azo dye (number average particle diameter: 2.5 μm) 1 part Low-molecular-weight polypropylene 3 parts The above materials were treated in the same manner as in Example 12 to give a red fine powder (a non-magnetic toner) with a weight average particle diameter ($D_4$) of 7.97 μm.

To 100 parts of the red fine powder thus obtained, 1.0 part of negatively chargeable hydrophobic dry-process silica (BET specific surface area: 240 $m^2/g$) was added, followed by mixing using a Henschel mixer to give a developer.

Data of its particle size distribution are shown in Table 13. The length average particle diameter on the basis of number ($D_1$) was 6.32 $\mu$m, the standard deviation of number-base distribution ($S_n$) was 2.07, the coefficient of variation of number-base distribution (A) was 32.8, the standard deviation of volume-base distribution ($S_W$) was 2.17, and the coefficient of variation of volume-base distribution (B) was 27.2.

A 100,000 sheet image reproduction was carried out in the same manner as in Example 12. As a result, all the image density, fog and toner scatter were at levels of no problem.

Detailed results of evaluation are as shown in Table 15 (15A–15C).

TABLE 13

| | | Number-base(%) | | Volume-base(%) | |
|---|---|---|---|---|---|
| Size ($\mu$m) | Number | Distri-bution | Cumu-lative | Distri-bution | Cumu-lative |
| 2.00–2.52 | 1,151 | 1.3 | 1.3 | 0.0 | 0.0 |
| 2.52–3.17 | 2,385 | 2.7 | 3.9 | 0.0 | 0.0 |
| 3.17–4.00 | 6,185 | 7.2 | 11.1 | 1.1 | 1.1 |
| 4.00–5.04 | 17,352 | 19.0 | 30.1 | 6.9 | 8.1 |
| 5.04–6.35 | 24,308 | 27.0 | 57.2 | 17.7 | 25.8 |
| 6.35–8.00 | 20,780 | 23.1 | 80.3 | 27.9 | 53.7 |
| 8.00–10.08 | 13,669 | 15.2 | 95.5 | 30.1 | 83.8 |
| 10.08–12.70 | 3,891 | 4.3 | 99.8 | 15.1 | 98.9 |
| 12.70–16.00 | 157 | 0.2 | 100.0 | 1.1 | 100.0 |
| 16.00–20.20 | 4 | 0.0 | 100.0 | 0.0 | 100.0 |
| 20.20–25.40 | 0 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

EXAMPLE 14

Cross-linked polyester resin (weight average molecular weight: 50,000; Tg: 60° C.) 100 parts Carbon black 3 parts Chromium complex of 3,5-di-tert-butylsalicylic acid 2 parts Low-molecular-weight propylene-ethylene copolymer 3 parts Using the above materials, a black fine powder was obtained in the same manner as in Example 12. To 100 parts of the black fine powder (a non-magnetic toner) thus obtained, 0.8 part of negatively chargeable hydrophobic dry-process silica (BET specific surface area: 300 $m^2/g$) was added, followed by mixing using a Henschel mixer to give a negatively chargeable non-magnetic developer. Using this developer, image evaluation was made in the same manner as in Example 12. Results obtained were good as shown in Table 15 (15A–15C).

EXAMPLE 15

A non-magnetic toner was prepared in the same manner as in Example 12 except that the chromium complex of 3,5-di-tert-butylsalicylic acid used therein was replaced with 2 parts of Nigrosine (number average particle diameter: about 3 $\mu$m) and the copper phthalocyanine was replaced with 3 parts of carbon black. To 100 parts of the non-magnetic toner thus obtained, 1.0 part of positively chargeable hydrophobic dry-process silica (BET specific surface area: 200 $m^2/g$) was added, followed by mixing using a Henschel mixer to give a positively chargeable one-component developer having the non-magnetic toner.

Then, using a modified machine of a copying machine NP4835, manufactured by Canon Inc., which was modified as shown in FIGS. 3 and 4, a continuous 100,000 sheet image reproduction was carried out to make evaluation. As a result, always stable and good images were obtained as shown in Table 15 (15A–15C).

EXAMPLE 16

Image evaluation was made in the same manner as in Example 12 except that, in the copying machine used to make evaluation in Example 12, the connecting position of the pipe was changed so that the untransferred toner (the toner scraped off by a cleaning means) was directly introduced into the developing assembly. As a result, as shown in Table 15 (15A–15C), good results were obtainable without great differences from those in Example 12.

Comparative Example 12

Evaluation was made in the same manner as in Example 12 except that the toner used therein was replaced with a toner prepared so as to have the particle size distribution as shown in Table 14, by controlling conditions for fine pulverization and classification. As a result, as shown in Table 15 (15A–15C), a decrease in reflection image density, a lowering of image quality and an increase in fog and toner scatter were seen as recycling was continued.

TABLE 14

| | | Number-base(%) | | Volume-base(%) | |
|---|---|---|---|---|---|
| Size ($\mu$m) | Number | Distri-bution | Cumu-lative | Distri-bution | Cumu-lative |
| 2.00–2.52 | 1,559 | 1.6 | 1.6 | 0.0 | 0.0 |
| 2.52–3.17 | 3,517 | 3.5 | 5.1 | 0.0 | 0.0 |
| 3.17–4.00 | 9,386 | 9.4 | 14.5 | 1.5 | 1.5 |
| 4.00–5.04 | 20,761 | 20.8 | 35.4 | 6.9 | 8.4 |
| 5.04–6.35 | 23,268 | 23.4 | 58.7 | 14.3 | 22.7 |
| 6.35–8.00 | 19,671 | 19.8 | 78.5 | 22.5 | 45.3 |
| 8.00–10.08 | 14,288 | 14.3 | 92.8 | 27.2 | 72.4 |
| 10.08–12.70 | 6,411 | 6.4 | 99.3 | 22.5 | 95.0 |
| 12.70–16.00 | 663 | 0.7 | 99.9 | 4.5 | 99.5 |
| 16.00–20.20 | 43 | 0.0 | 100.0 | 0.5 | 100.0 |
| 20.20–25.40 | 10 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Comparative Example 13

Evaluation was made in the same manner as in Example 13 except that the toner used therein was replaced with a toner prepared so as to have the particle size distribution as shown in Table 15, by controlling conditions for fine pulverization and classification.

Results obtained are shown in Table 15 (15A–15C).

Comparative Example 14

Evaluation was made in the same manner as in Example 14 except that the toner used therein was replaced with a toner prepared so as to have the particle size distribution as shown in Table 15, by controlling conditions for fine pulverization and classification.

Results obtained are shown in Table 15 (15A–15C).

Comparative Example 15

Evaluation was made in the same manner as in Example 15 except that the toner used therein was replaced with a toner prepared so a to have the particle size distribution as shown in Table 15, by controlling conditions for fine pulverization and classification. As a result, as shown in Table 15 (15A–15C), the levels of all the image density, image quality, fog and toner scatter were seen to become lower as the recycled toner was reused.

Comparative Example 16

Evaluation was made in the same manner as in Example 12 except that the untransferred toner used therein (the toner scraped off by a cleaning means) was not reused. As a result, as shown in Table 15 (15A–15C), although there was no problems at all in regard to the image quality after copying on 100,000 sheets, toner consumption was 0.054 g/sheet, and was seen to have increased by as much as 20% compared with the case of Example 12.

TABLE 15A

| | Particle size distribution of supply nonmagnetic toner | | | | | |
|---|---|---|---|---|---|---|
| | $D_1$ (μm) | $S_n$ | A | $D_4$ (μm) | $S_w$ | B |
| Example: | | | | | | |
| 12 | 6.42 | 2.25 | 35.0 | 8.30 | 2.35 | 28.3 |
| 13 | 6.32 | 2.07 | 32.8 | 7.97 | 2.17 | 27.2 |
| 14 | 6.61 | 2.36 | 35.7 | 8.62 | 2.40 | 27.9 |
| 15 | 6.81 | 2.33 | 34.1 | 8.66 | 2.32 | 26.8 |
| 16 | 6.42 | 2.25 | 35.0 | 8.30 | 2.35 | 28.3 |
| Comparative Example: | | | | | | |
| 12 | 6.30 | 2.35 | 37.3 | 8.56 | 3.16 | 36.4 |
| 13 | 6.17 | 2.50 | 40.6 | 8.58 | 2.45 | 28.5 |
| 14 | 8.32 | 3.04 | 36.6 | 11.59 | 2.70 | 23.3 |
| 15 | 6.81 | 2.75 | 40.4 | 9.45 | 3.06 | 32.4 |
| 16 | 6.42 | 2.25 | 35.0 | 8.30 | 2.35 | 28.3 |

TABLE 15B

| | Particle size distribn of collected non magnetic toner | | | | | |
|---|---|---|---|---|---|---|
| | $D_1$ (μm) | $S_n$ | A | $D_4$ (μm) | $S_w$ | B |
| Example: | | | | | | |
| 12 | 6.23 | 2.57 | 41.3 | 8.45 | 2.81 | 33.3 |
| 13 | 6.54 | 2.65 | 40.5 | 8.15 | 2.84 | 34.8 |
| 14 | 6.43 | 2.49 | 38.7 | 8.58 | 2.79 | 32.5 |
| 15 | 6.68 | 2.61 | 39.1 | 8.73 | 2.55 | 29.2 |
| 16 | 6.51 | 2.58 | 39.6 | 8.17 | 2.74 | 33.5 |
| Comparative Example: | | | | | | |
| 12 | 7.84 | 3.47 | 44.2 | 10.25 | 4.13 | 40.3 |
| 13 | 4.83 | 2.28 | 47.2 | 7.91 | 2.71 | 34.3 |
| 14 | 8.75 | 3.75 | 42.9 | 14.22 | 4.21 | 29.6 |
| 15 | 5.36 | 2.62 | 48.8 | 9.48 | 3.48 | 36.7 |
| 16 | — | — | — | — | — | — |

TABLE 15C

| | Evaluation results at the start | | | | Evaluation results after running on 100,000 sheets | | | | Toner consumption |
|---|---|---|---|---|---|---|---|---|---|
| | Dmax | (1) | (2) | (3) | Dmax | (1) | (2) | (3) | (g/sheet) |
| Example: | | | | | | | | | |
| 12 | 1.25 | A | A | A | 1.26 | A | A | A | 0.045 |
| 13 | 1.24 | A | A | A | 1.23 | A | A | A | 0.043 |
| 14 | 1.37 | A | A | A | 1.38 | A | A | A | 0.047 |
| 15 | 1.33 | A | A | A | 1.36 | A | A | A | 0.050 |
| 16 | 1.25 | A | A | A | 1.24 | A | A | A | 0.044 *1 |
| Comparative Example: | | | | | | | | | |
| 12 | 1.24 | A | A | A | 1.10 | BC | B | B | 0.047 |
| 13 | 1.23 | A | A | A | 1.05 | BC | C | BC | 0.049 |
| 14 | 1.20 | A | A | A | 1.10 | B | B | B | 0.042 |
| 15 | 1.20 | AB | AB | A | 0.85 | C | C | C | 0.051 |
| 16 | 1.25 | A | A | A | 1.27 | A | A | A | 0.057 *2 |

(1): Image quality, (2): Fog level, (3): Toner scatter
A, B, BC, C: The same as in Table 1; AB: Good
Remarks:
*1 The collected toner was returned to the developing assembly.
*2 The collected toner was not recycled.

As having been described above, the present invention is an image forming method in which toner having a specific particle size distribution is used, the untransferred toner remaining on the latent image bearing member is recovered or collected after development has been made using the toner and the toner image has been transferred, and the recovered or collected toner is reused. It brings about the following advantages.

(1) Copied images having a reflection image density always maintained at an high level and having a superior image quality without occurrence of fog and toner scatter can be obtained even when copies are made over a long period of time on a large number of sheets.

(2) Use of the recycled toner enables effective utilization of toner, and a high image density can be achieved at a smaller toner consumption.

We claim:

1. An image forming method comprising the steps of;

forming a latent image on an image bearing member;

developing the latent image formed on the image bearing member with a developing means including a developing sleeve and a developer container containing a supply of toner, while applying an alternating electric field between said image bearing member and said developing sleeve;

transferring the toner image from the image bearing member to a transfer medium with a transfer means to which a bias is applied;

cleaning the image bearing member from which the toner image has been transferred to the transfer medium, to collect the toner remaining on the image bearing member as collected toner; and feeding the toner collected in said cleaning step to said developer container of said developing means for reuse by the developing means in a subsequent step of developing a latent image to form a toner image;

wherein said supply toner and said collected toner comprise a binder resin and at least one of a magnetic powder and a colorant, (i) said supply toner having:

a weight average particle diameter ($D_4$) of from 4 $\mu$m to 11 $\mu$m;

a supply toner coefficient A(S) of variation of number-base distribution of 20 to 40, which is a coefficient represented by the formula:

$$A(S)=(S_n/D_1)\times 100$$

wherein $S_n$ represents a standard deviation of number-base distribution, and $D_1$ represents a length average particle diameter ($\mu$m) on the basis of number; and a supply toner coefficient B(S) of variation of volume-base distribution of 15 to 30, which is a coefficient represented by the formula:

$$B(S)=(S_W/D_4)\times 100$$

wherein $S_W$ represents a standard deviation of volume-base distribution of such supply toner, and $D_4$ represents a weight average particle diameter ($\mu$m) on the basis of weight of said supply toner;

(ii) said collected toner having:

a collected toner coefficient A(R) of variation of number-base distribution of from 25 to 45, wherein the collected toner coefficient A(R) has the same definition as that of the supply toner coefficient A(S), and a collected toner coefficient B(R) of variation of volume-base distribution of from 15 to 35, wherein the collected toner coefficient B(R) has the same definition as that of the supply toner coefficient B(S);

wherein A(R) and B(R) are determined by the above-given formulas used to determine the supply toner coefficients but using collected toner distribution data, and wherein a greatest peak and a second greatest peak in a histogram of volume-base distribution of the collected toner fall in the same particle diameter ranges as a greatest peak and a second greatest peak in a histogram of volume-base distribution of the supply toner having corresponding particle diameter ranges.

2. The image forming method according to claim 1, wherein said supply toner has a weight average particle diameter ($D_4$) of from 4 $\mu$m to 8 $\mu$m, has a coefficient A(S) of variation of number-base distribution, of from 20 to 30, and has a coefficient B(S) of variation of volume-base distribution of from 15 to 25.

3. The image forming method according to claim 1, wherein said latent image is developed by a magnetic toner.

4. The image forming method according to claim 1, wherein said latent image is developed by a developer comprising a non-magnetic toner and a carrier.

5. The image forming method according to claim 1, wherein said latent image is developed by a non-magnetic toner.

6. The image forming method according to claim 1, further comprising the step of mixing said collected toner with supply toner in a toner hopper and thereafter feeding the mixed toner to the developer container of the developing means.

7. The image forming method according to claim 1, wherein said supply toner has a coefficient A(S) of variation of number-base distribution of from 25 to 35, and has a coefficient B(S) of variation of volume-base distribution of from 15 to 28, and said collected toner has a coefficient A(R) of variation of number-base distribution of from 25 to 40, and has a coefficient B(R) of variation of volume-base distribution of from 25 to 35.

8. The image forming method according to claim 1, wherein the ratio of the coefficient A(R) of variation of number-base distribution of the collected toner to the coefficient A(S) of variation of number-base distribution of the supply toner, A(R)/A(S), is from 0.93 to 1.3, and the ratio of the coefficient B(R) of variation of volume-base distribution of the collected toner to the coefficient B(S) of variation of volume-base distribution of the supply toner, B(R)/B(S), is from 0.93 to 1.3.

9. The image forming method according to claim 6, wherein said collected toner has a property such that, when a plurality of particle-size ranges are defined by the limits, in $\mu$m, 2.00 to 2.52, 2.52 to 3.17, 3.17 to 4.00, 4.00 to 5.04, 5.04 to 6.35, 6.35 to 8.00, 8.00 to 10.08, 10.08 to 12.70, 12.70 to 16.00, 16.00 to 20.20, 20.20 to 25.40, 25.40 to 32.00, and 32.00 to 40.30, the two ranges which contain the greatest and second greatest peaks in a histogram of the number-base distribution of said collected toner each contain 15% or more by number of particles of the collected toner, and has a property such that, the two ranges which contain the greatest and second greatest peaks in a histogram of the volume-base distribution of said collected toner each contain 20% or more by volume of the collected toner.

10. The image forming method according to claim 9, wherein said collected toner has a property such that, the two ranges which contain the greatest and second greatest peaks in a histogram of number-base distribution of said collected toner each contain 20% or more by number of particles of the collected toner, and has a property such that, the two ranges which contain the greatest and second greatest peaks in a histogram of the volume-base distribution of said collected toner each contain 25% or more by volume of the collected toner.

11. The image forming method according to claim 1, wherein the alternating electric field is formed by applying an asymmetric bias to the developing sleeve.

* * * * *

UNITED STATES PATENT AND TRADEMARK OFFICE

CERTIFICATE OF CORRECTION

PATENT NO. : 5,849,453

DATED : December 15, 1998

INVENTOR(S) : YUSHI MIKURIYA, ET AL.

It is certified that error appears in the above-identified patent and that said Letters Patent is hereby corrected as shown below:

COVER PAGE AT ITEM [56] REFERENCES CITED,
Foreign Patent Documents, "1214874" should read --1-214874--, "2157765" should read --2-157765--, and "02284156" should read --2-284156--.

FIGURE 1,
"d" should read --α--.

COLUMN 1,
Line 24, "the fixing" should read --fixing the--; and
Line 61, "becomes" should read --become--.

COLUMN 2,
Line 5, "4,299,990" should read --4,299,900--;
Line 39, "invention" should read --inventions--; and
Line 58, "comprising;" should read --comprising:--.

COLUMN 3,
Line 7, "having;" should read --having:--; and
Line 39, "reuse," should read --reused,--.

COLUMN 4,
Line 7, "that is" should read --that is,--.

COLUMN 14,
Line 46, "gap a" should read --gap α--.

UNITED STATES PATENT AND TRADEMARK OFFICE

CERTIFICATE OF CORRECTION

PATENT NO. : 5,849,453

DATED : December 15, 1998

INVENTOR(S) : YUSHI MIKURIYA, ET AL.

It is certified that error appears in the above-identified patent and that said Letters Patent is hereby corrected as shown below:

COLUMN 15,
Line 62, "kg/cm" should read --kg/cm$^2$.--.

COLUMN 19,
Line 47, "125" should read --129--; and
Line 58, "126" should read --136--.

COLUMN 24,
Line 52, "was" should read --were--.

COLUMN 26,
Line 38, "6.53 82" should read --6.53--; and
Line 39, "m," should read --μm,--.

COLUMN 30,
Line 2, "was" should read --were--.

COLUMN 35,
Line 6, "so a" should read --so as--; and
Line 22, "was" should read --were--.

COLUMN 36,
Line 36, "an" should read --a--; and
Line 45, "of;" should read --of:--.

UNITED STATES PATENT AND TRADEMARK OFFICE

CERTIFICATE OF CORRECTION

PATENT NO. : 5,849,453

DATED : December 15, 1998

INVENTOR(S) : YUSHI MIKURIYA, ET AL.

It is certified that error appears in the above-identified patent and that said Letters Patent is hereby corrected as shown below:

COLUMN 38,
Line 24, "claim 6," should read --claim 1,--.

Signed and Sealed this

Twenty-first Day of September, 1999

*Attest:*

Q. TODD DICKINSON

*Attesting Officer*

*Acting Commissioner of Patents and Trademarks*